US008356908B1

(12) United States Patent
Zadro

(10) Patent No.: US 8,356,908 B1
(45) Date of Patent: Jan. 22, 2013

(54) ROTATABLE DUAL MAGNIFICATION MIRROR WITH INTERNAL HOOP ILLUMINATOR AND MOVABLE REFLECTOR RING

(76) Inventor: Zlatko Zadro, Huntington Beach, CA (US)

( * ) Notice: Subject to any disclaimer, the term of this patent is extended or adjusted under 35 U.S.C. 154(b) by 543 days.

(21) Appl. No.: 12/657,583

(22) Filed: Jan. 25, 2010

Related U.S. Application Data

(63) Continuation-in-part of application No. 12/454,865, filed on May 27, 2009, now Pat. No. 8,162,502.

(51) Int. Cl.
*F21V 33/00* (2006.01)

(52) U.S. Cl. ..... 362/136; 362/135; 362/140; 362/142; 362/249.03; 362/249.1

(58) Field of Classification Search ..... 362/234, 362/249.03, 249.07, 249.1, 413, 427, 135–144
See application file for complete search history.

(56) References Cited

U.S. PATENT DOCUMENTS 5,997,149 A * 12/1999 Chu ..... 362/142
6,848,822 B2 * 2/2005 Ballen et al. ..... 362/577
7,048,406 B1 * 5/2006 Shih ..... 362/135
7,393,115 B2 * 7/2008 Tokushita et al. ..... 362/136

* cited by examiner

*Primary Examiner* — Meghan Dunwiddie
(74) *Attorney, Agent, or Firm* — William L. Chapin

(57) ABSTRACT

A mirror includes a frame holding back-to-back a pair of reflective mirror plates having different magnification factors, each plate having a reflective central area and an outer concentric light-transmissive window area. Rotatable pivot joints supporting the frame between opposed arms of a support yoke and enable the frame to be rotated to orient a selected plate in a forward-facing use position. A hoop-shaped printed circuit board having circumferentially spaced apart light emitting diodes (LED's) protruding therefrom is located between inner facing surfaces of the mirror plates. Objects in front of a mirror plates are illuminated by direct LED rays emitted forwardly through the window areas and by indirect LED rays reflected from reflective inner facing surfaces of the mirror plates, and from the forward facing surface of a movable reflector ring within the frame which falls rearward when the frame is rotated.

42 Claims, 21 Drawing Sheets

48
64
50
78
90
96
51
95
89
49
47
99
70
112
69
46
107
66
96A
98
97
95A
71
44
72
74
77
73
67
45
68
65
37
39
41
40
25
36
26
21
33

49
69
71
-1X-
89
95A
95
51
78
48
90
107
72
46
65
-5X-
44
108
47
64A
45
72
50
70
64
66

ROTATABLE DUAL MAGNIFICATION MIRROR WITH INTERNAL HOOP ILLUMINATOR AND MOVABLE REFLECTOR RING

The present application is a continuation-in-part of U.S. patent application Ser. No. 12/454,865, filed on May 27, 2009, now U.S. Pat. No. 8,162,502.

BACKGROUND OF THE INVENTION

A. Field of the Invention

The present invention relates to mirrors of the type used by people to facilitate performance of personal appearance related functions such as shaving, applying cosmetics and the like. More particularly, the invention relates to a versatile free-standing mirror which includes a base for supporting the mirror on a horizontal surface such as that of a table top, and a frame containing back-to-back mirror plates of different magnification factors, the frame being pivotably mounted to the base by a continuously rotatable joint and containing an internal flexible hoop-shaped illuminator which encircles the mirror plates and emits light forwards and backwards to thus illuminate object fields adjacent to both front and rear mirror plates.

B. Description of Background Art

Certain aspects of a person's appearance are best attended to by observing a person's image in a relatively large "wide angle" mirror, which has a flat reflective surface that provides a unity or "1×" magnification. Mirrors of this type include full length wall mirrors, dresser mirrors, and bathroom mirrors mounted on a wall or cabinet. Other grooming functions such as shaving, applying cosmetics and the like are generally more easily performed while viewing a larger image of one's face, which can be obtained by positioning the face closer to a flat, non-magnifying mirror. In some circumstances, however, it is not convenient to position one's face sufficiently close to an existing flat mirror to provide an image which is sufficiently large to enable a desired personal grooming task to be easily performed. In such situations, it would be desirable to have available a magnifying mirror, i.e., a mirror having a magnification factor greater than one.

Since counter space available in locations such as bathrooms is often at a premium, it would also be desirable to have available a portable magnifying mirror which may be readily placed in a free-standing disposition on a horizontal surface, such as that of an existing table top or vanity top. Additionally, since different mirror magnifications are useful for performing different aspects of a person's grooming, it would be desirable to have a portable free-standing mirror, which had at least two different, selectable magnifications.

A wide variety of magnifying and non-magnifying mirrors are available for personal use. However, since a person's vision generally degrades with age, there is an accompanying need for a mirror of selectable magnification which can supplement existing larger mirrors to enable a person to see image details required to perform personal care functions.

In response to a perceived need for mirrors having different magnification factors, a variety of mirrors have been disclosed which can provide more than just one magnification factor, e.g., 1× and 5×. Examples of such mirrors include the present inventor's U.S. design Pat. No. D532,981 for a Dual Magnification Table Mirror, U.S. Pat. No. 7,341,356 for a Dual Magnification Vanity Mirror Adjustable In Height And Orientation, and U.S. Pat. No. 6,854,852 for a Dual Magnification Reversible Spot Mirror Releasably Attachable To Flat Surfaces.

Dual magnification mirrors of the type described above provide a satisfactory solution to the requirement for personal mirrors having selectable magnifications. However, there are applications, such as in dimly lit rooms, where it would be desirable to have a mirror which includes an illumination source for illuminating an object such as a person's face positioned in front of the mirror. Thus, there have been disclosed a variety of mirrors which contain an illumination source, including the present inventor's U.S. Pat. No. 6,158,877 for a Magnifying Mirror Having Focused Annular Illuminator and U.S. Pat. No. 7,090,378 for a Dual Magnification Folding Travel Mirror With Annular Illuminator.

The illuminated mirrors disclosed in the foregoing patents have proved magnification mirror which has back-to-back mirrors mounted in a frame that includes an illumination source which provides substantially equal illumination of object fields located in front of either mirror, is rotatable continuously without the possibility of twisting electrical wires used to carry electrical current to the illumination source, and which is powered by batteries contained within the base of the mirror and thus not requiring a power cord for connection to power mains. The present invention was conceived of at least in part to fulfill the aforementioned needs.

OBJECTS OF THE INVENTION

An object of the present invention is to provide a mirror which has two reflective mirror plates of different magnification factors mounted back-to-back in a frame that contains an internal illumination source which emits light both forwards and backwards to thus illuminate object fields adjacent to both front and rear mirror plates.

Another object of the invention is to provide a dual magnification mirror which includes a frame holding back-to-back mirror plates and an internal illumination source that is powered by batteries within a base to which the frame is pivotably mounted.

Another object of the invention is to provide an illuminated dual magnification mirror which includes a frame holding a pair of back-to-back mirror plates and an internal illumination source effective in illuminating object fields in front of both mirrors, the frame being supported by a base including a battery power source electrically connected to the illumination source though a pivot joint which enables continuous rotation of the mirror frame with respect to the base, thus enabling orientation of the mirror plates at any desired pivot angle.

Another object of the invention is to provide an illumination source for mirrors which includes a printed circuit board that consists of an elongated thin, narrow strip of flexibly curvable material which has protruding from an upper surface thereof a plurality of electrically energizable light sources operably interconnected to electrical circuitry on the board, the board having opposite transverse ends thereof secured together to form a ring which is flexibly bowable into arcuately curved circular or oval hoop shapes suitable for providing peripheral illumination of circular or oval mirrors.

Another object of the invention is to provide a mirror which has first and second reflective mirror plates of different magnification factors mounted in a frame on opposite sides of an illumination source within the frame which emits light both forward through a front annular window which circumscribes the first mirror plate and rearward through a rear annular window which circumscribes the second mirror plate, the frame enclosing a an annular ring-shaped reflector plate which has a central perforation of larger diameter than the illumination source which is movable under the force of gravity as the mirror frame is pivoted 180 degrees to thus position a mirror plate of selected magnification to a forward facing use position to a location rearward of the illumination source and thereby reflecting light rays emitted rearwardly from the illumination source forward through the mirror window which circumscribes the front-facing mirror plate.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a dual magnification mirror which has back-to-back mirror plates of different magnification factors and an illumination source which is effective in illuminating object fields in front of both mirror plates. According to the invention, the mirror includes a tabular base which holds therein batteries for powering the illumination source, and a support stanchion which protrudes vertically upwards from the center of the base. The mirror includes a downwardly concave, generally semi-circularly shaped mirror frame support yoke mounted onto the upper end of the stanchion. A pair of laterally inwardly facing, diametrically opposed horizontally disposed mirror frame pivot bosses protrude inwardly from opposite upper ends of the laterally opposed, quadrant-shaped left and right arms of the yoke.

According to the invention, the mirror frame support yoke has a hollow tubular construction, and includes a separate electrical power supply wire disposed downwardly through each pivot bushing and yoke arm. Lower ends of the wires meet at the lower center of the yoke, and thread through a hollow tubular passage disposed vertically through the stanchion to connect to a battery compartment and on/off switch mounted in the base of the mirror. Upper ends of the electrical power supply wires are connected to laterally outwardly located ends of a pair of left and right electrically conductive bearing cups which are inset coaxially into the pivot bosses.

In a preferred embodiment, in which the yoke and pivot bosses are made of metal, the conductive cups are mounted coaxially within cylindrical insulator bushings fitted within coaxial bores within the pivot bosses to provide electrical isolation between the conductive cups in the pivot bosses.

The mirror according to the present invention include a ring-shaped frame which holds coaxially therewithin a pair of back-to-back reflective mirror plates having different magnification factors, e.g., 1× and 5×. Each mirror plate has a relatively large diameter central reflective area and a relatively narrow, outer annular band-shaped light transmissive window area.

The outer annular ring-shaped light transmissive regions of the two back-to-back reflective mirror plates are axially aligned, and positioned radially outwardly of an annular ring-shaped illumination source located between inner facing sides of the mirror plates. In a preferred embodiment, the inner facing surface of each mirror plate has thereon a surface which specularly or diffusely reflects light emitted from the ring-shaped illumination source, thus directing light to the annular ring-shaped windows of opposed mirror plates.

According to the invention, insulated electrically conductive leads for providing electrical power to the illumination source within the mirror frame are connected to a pair of opposed pivot pins which protrude radially outwardly from laterally opposed sides of the mirror frame. The pivot pins are electrically isolated from each other and from the frame, and have convex, arcuately rounded outer transverse end faces which are of a size and shape similar to concavely rounded inner transverse end faces of the conductive bearing cups within the yoke arm bosses. The pivot pins are rotatably held within the conductive yoke arm bearing cups by resilient forces which are sufficient to insure electrical contact between each pin and cup set, and to maintain the mirror at an adjusted pivot angle relative to the yoke and base, yet enable the mirror frame to be relatively easily rotated to a desired pivot angle.

In a preferred embodiment, the resilient pivot retention force is provided by fabricating the yoke from a material which is elastically deformable in response to a radially outwardly directed tensioning force to a larger diameter to thus enable insertion of the pivot pins into the conductive cups. Removing the outward tensioning force enables the yoke arms to spring elastically inwards, thus retaining the mirror frame pivot pins within the conductive cups in the bosses at the ends of the yoke arms.

According to the invention, the annular ring-shaped illumination source is constructed in a manner that enables the mirror frame to have a substantially thinner, more aesthetically satisfying appearance than prior-art illumination mirrors which employ incandescent or fluorescent illumination sources. Thus, according to the present invention, the illumination source includes a thin, flat, annular ring-shaped printed circuit board on which are mounted a plurality of light emitting diodes (LED's). The LED's protrude radially outwards of the outer circumferential edge wall of the printed circuit board.

In an example embodiment, each LED had a cylindrically-shaped, body and a pair of conductive leads which protruded rearward from the body. Rear ends of the leads were bent at ninety degree angles and inserted into and soldered to conductive eyelets electrically continuous with a pair of conductive foil strips arranged concentrically on the pivoted circuit board.

In the example embodiment, 22 white-light emitting LEDs spaced at equal circumferential intervals of about 16 degrees were used. Each conductive foil is electrically conductively connected to a separate one of the two electrically isolated pivot pins. Thus, electrical current conveyed to the electrically conductive bearing cups in the yoke arm pivot bosses is carried through the pivot pins and thence to the LED's.

The novel design and construction of an illuminated dual magnification mirror according to the present invention provides an equally bright, uniform illumination pattern in object fields located in front of both mirror plates. Moreover, the novel design and construction of the mirror according to the present invention advantageously enables the mirror frame to be continuously rotated to thus position the 1× or 5× magnifying mirror plates at any desired angle with respect to the mirror frame support yoke, without the possibility of twisting or breaking electrical illumination wires which power the illumination source within the mirror frame.

An alternate illumination source according to the present invention utilizes a printed circuit board (PCB) which includes an elongated strip of an insulating material such as fiberglass-filled epoxy, the strip being sufficiently thin and narrow to give it enough flexibility to be arcuately curved into a closed circular or oval hoop. The PCB has protruding from an upper flat surface thereof a plurality of radially disposed, longitudinally spaced apart light emitting diodes (LED's). One lead of each LED is electrically connected to one terminal of a separate surface-mount or thick-film ballast resistor located on the lower side of the PCB, between an adjacent pair of LED's. The other terminal of each ballast resistor is connected to a first longitudinally disposed electrically conductive runner trace on the PCB. The second lead of each LED is connected to a second electrically conductive runner trace on the PCB. The two traces are electrically connected to a source of electrical power, such as a battery pack located in the mirror.

In a preferred embodiment, the flexible PCB is bent into a closed, hoop-shaped ring, and opposite transverse ends of the PCB fastened to each other by suitable means, such as a pair of staples which may optionally connect to separate ones of the two runner traces on the PCB. In this novel embodiment, the illumination source hoop may be flexibly deformed from a circular shape for use with circular mirrors, or into an oval shape for use with oval mirrors.

According to another aspect of the invention, a mirror having first and second mirror plates of different magnification factors, e.g., 1× and 5×, located on opposite sides of a circular internal illumination source includes a gravity operated annular ring shaped light reflector plate which is concentrically located within a circular ring-shaped frame. The reflector has an outer circumferential edge which is slidably located within an annular ring-shaped channel in the inner side of the frame, and a central coaxial hole of larger diameter than the outer diameter of the illumination source. This construction enables the reflector ring to fall under the force of gravity when the mirror frame is pivoted to a horizontal position, thus positioning the reflector ring rearward of the illumination source where it is effective in reflecting light rays emitted rearward from the illumination source forwards and out through the annular window circumscribing a mirror plate, such as the 1×-magnification mirror plate, which is located in a front facing or slightly rearwardly tilted orientation when the mirror frame is pivoted away from a horizontal orientation. When the mirror frame is tilted 180 degrees to position the other mirror plate, e.g., a 5×-magnification mirror plate, in a forward facing use orientation, as the frame moves through a horizontal orientation, the reflector ring drops towards the opposite mirror plate to the side of the illumination source opposite that of the front-facing mirror plate, where it is effective in reflecting light rays emitted rearwardly from the illumination source forward through the annular window circumscribing the front-facing 5× mirror plate.

BRIEF DESCRIPTION OF THE DRAWINGS

FIG. 14 is a rear elevation view of an illumination source of the type shown in

FIG. 8.

DESCRIPTION OF THE PREFERRED EMBODIMENTS

Figure 14:
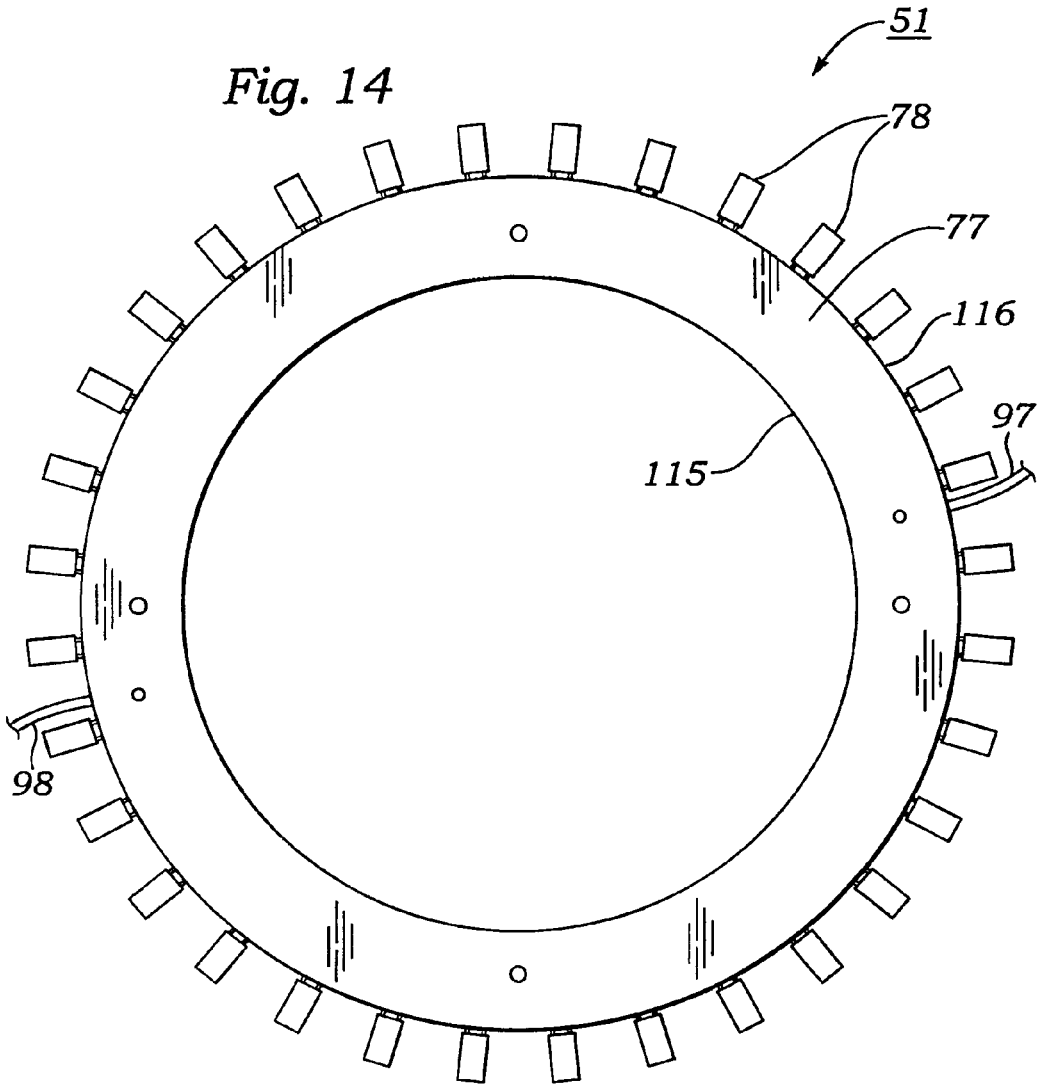
Figure 15:
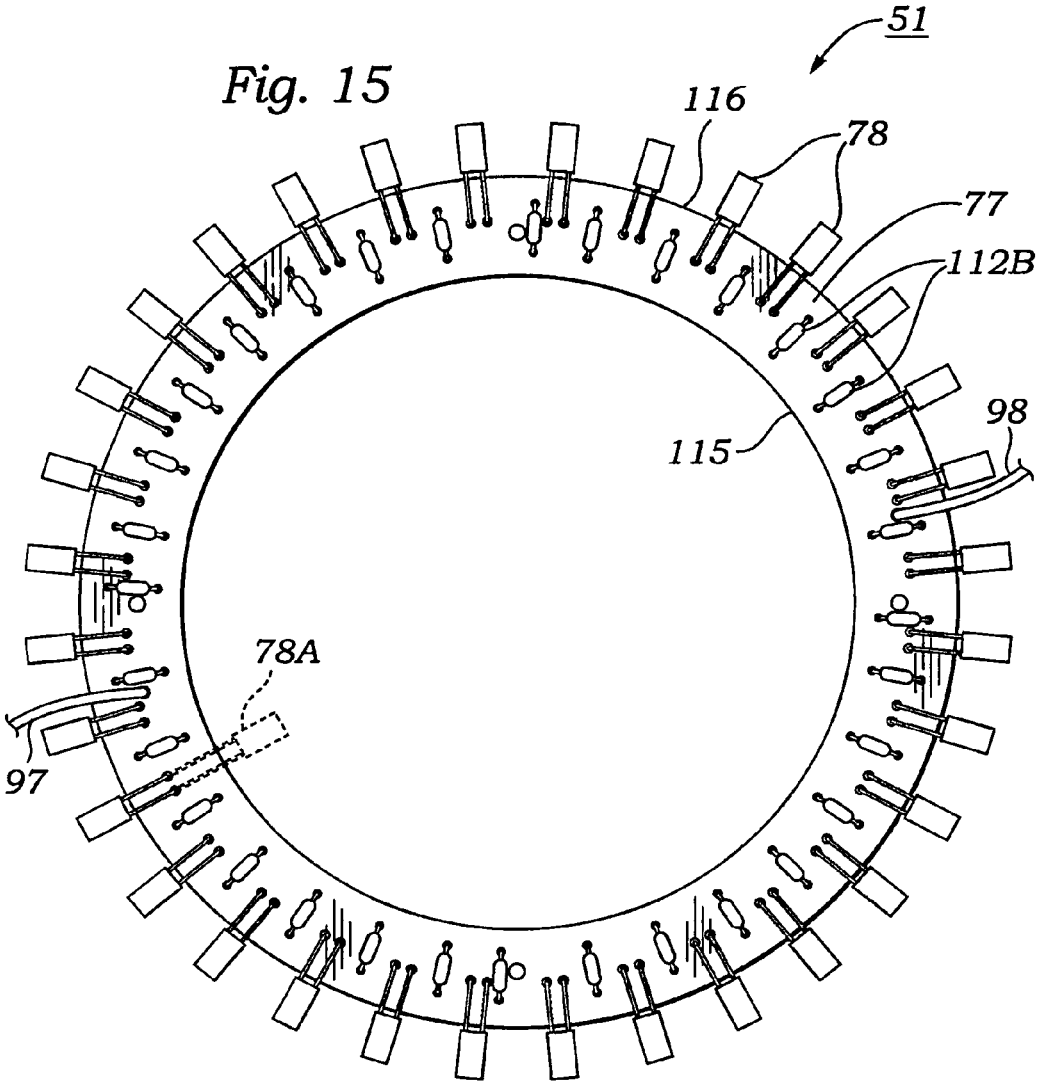
FIG. 15 is a front elevation view of the illumination source of FIG. 14.
Figure 25:
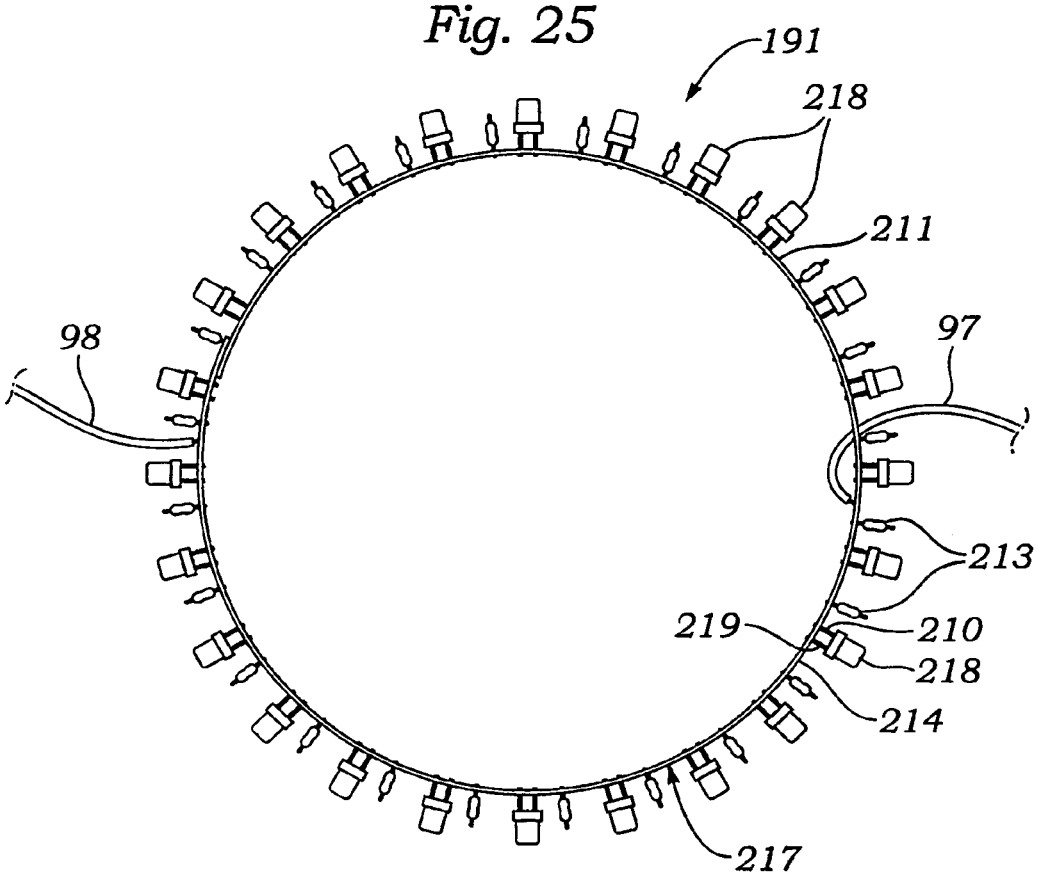
FIG. 25 is a side elevation view of a modification of the alternate illumination source of FIG. 22, which uses discrete radially mounted ballast resistors.
Figure 26:
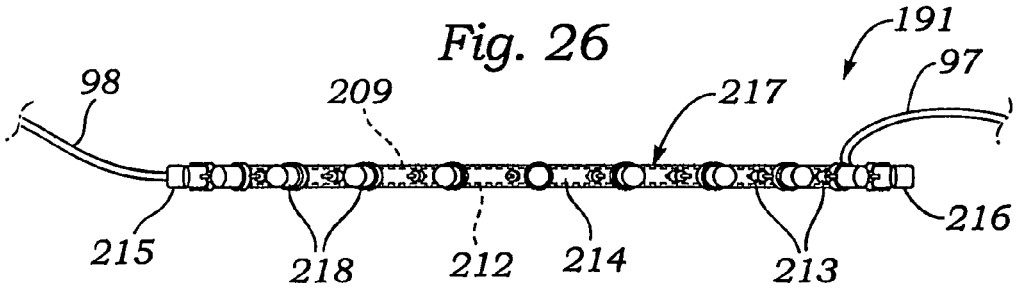
FIG. 26 is an upper plan view of the modified illumination source of FIG. 25

FIGS. 1-13 illustrate an illuminated continuously rotatable dual magnification mirror according to the present invention. FIGS. 14-15 illustrate details of an annular ring-shaped illumination source of the mirror shown in FIGS. 1-13. FIGS. 16-22 and 24 illustrate an alternate embodiment of an illumination source for the mirror of FIGS. 1-13. FIG. 23 illustrates a modification of the mirror of FIGS. 1-13 which uses a modification of the illumination source shown in FIG. 22. FIGS. 25 and 26 illustrate a modification of the for the figures of 1-7, in which LED light sources thereof protrude radially inwards. FIGS. 29-34 illustrate a modification of the mirrors of FIGS. 1-7 which includes a movable internal reflector ring.

Referring first to FIGS. 1-4, it may be seen that an illuminated continuously rotatable dual magnification mirror 20 according to the present invention includes a hollow, circularly-shaped base 21 which has a flat lower wall 22 for placement on a supporting surface such as a table top. As may be seen best by referring to FIGS. 9 and 10, base 21 has located between lower wall 22 and an upper wall 23 thereof a hollow interior space 24 which contains a battery holder 25 that is accessible via a rectangularly-shaped trap door 26 which snaps into a similarly-shaped access port 27 disposed through the lower wall 22 of the base.

Figure 9:
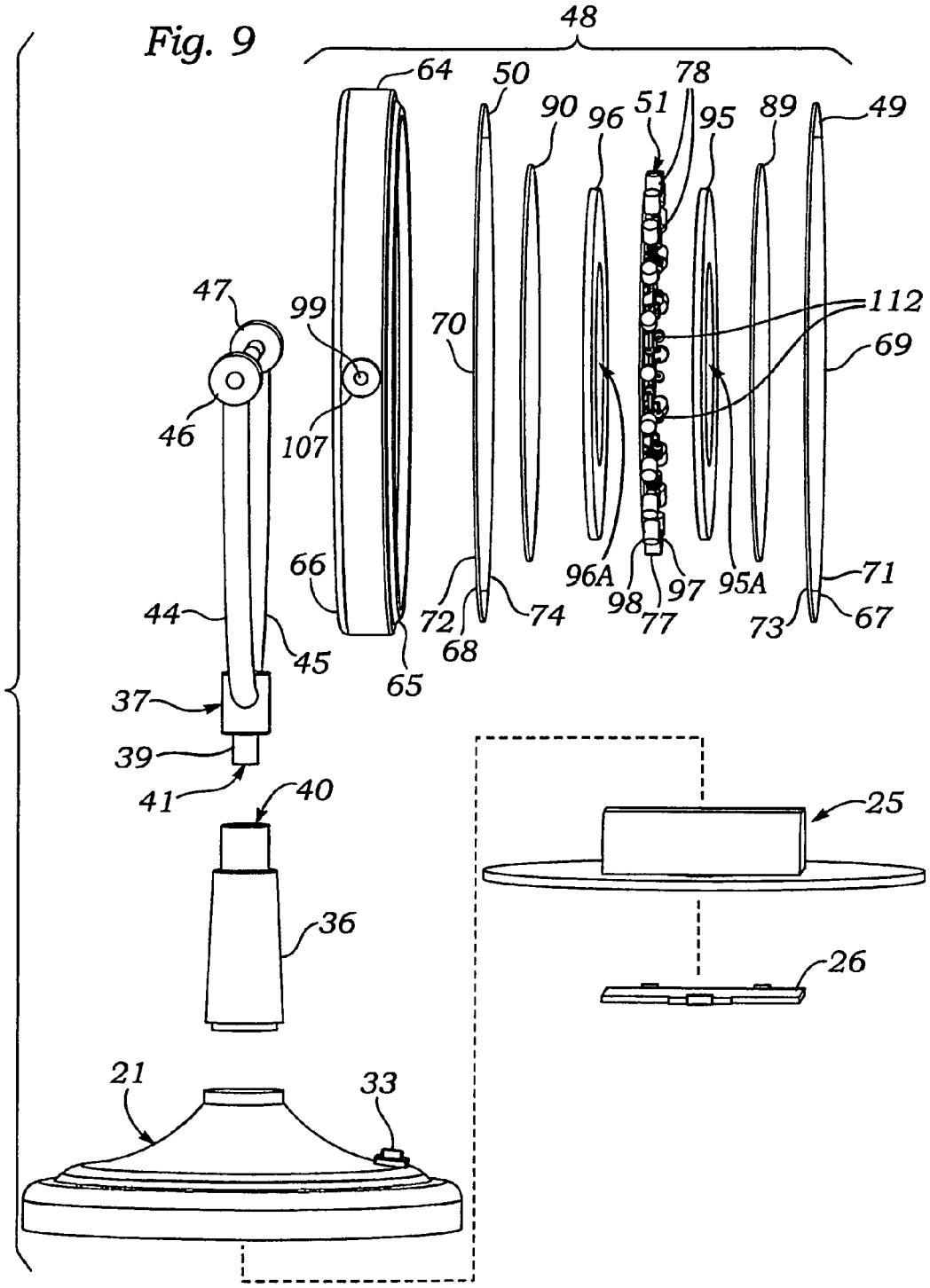
FIG. 9 is an exploded side view of the mirror of FIG. 1.
Figure 11:
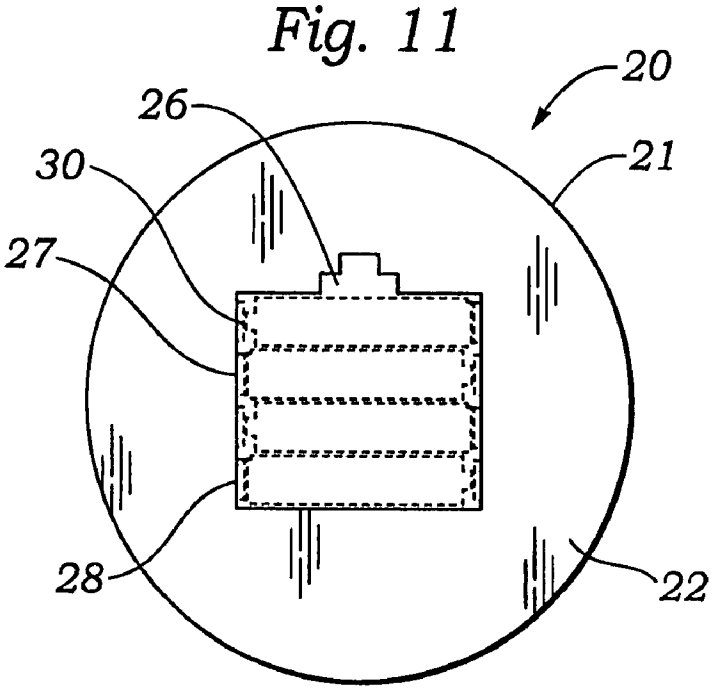
FIG. 11 is a lower plan view of the mirror of FIG. 5, showing a battery compartment cover thereof removed.

As shown in FIGS. 9 and 11, battery holder 25, which in an example embodiment was constructed to hold 4 A-A batteries connected in series, has a first, common terminal 28 to which is electrically connected a flexible insulated, common output connector lead 29. As shown in the figures, battery holder 25 also has a second output terminal 30 which is connected through an interconnect lead 31 to a first, input terminal 32 of an on/off switch 33. Switch 33 has a second, switched terminal 34 to which is connected a flexible, insulated switched power lead 35.

Referring to FIGS. 1-4, 9 and 11, it may be seen that mirror 20 includes a hollow, circular cross-section tubular stanchion 36 which protrudes upwardly from the center of upper wall 23 of base 21. As shown in the figures, upper wall 23 of base 21 has a convex, lenticular vertical transverse sectional shape, but the shape is not critical, and may, for example be flat.

Figure 2:
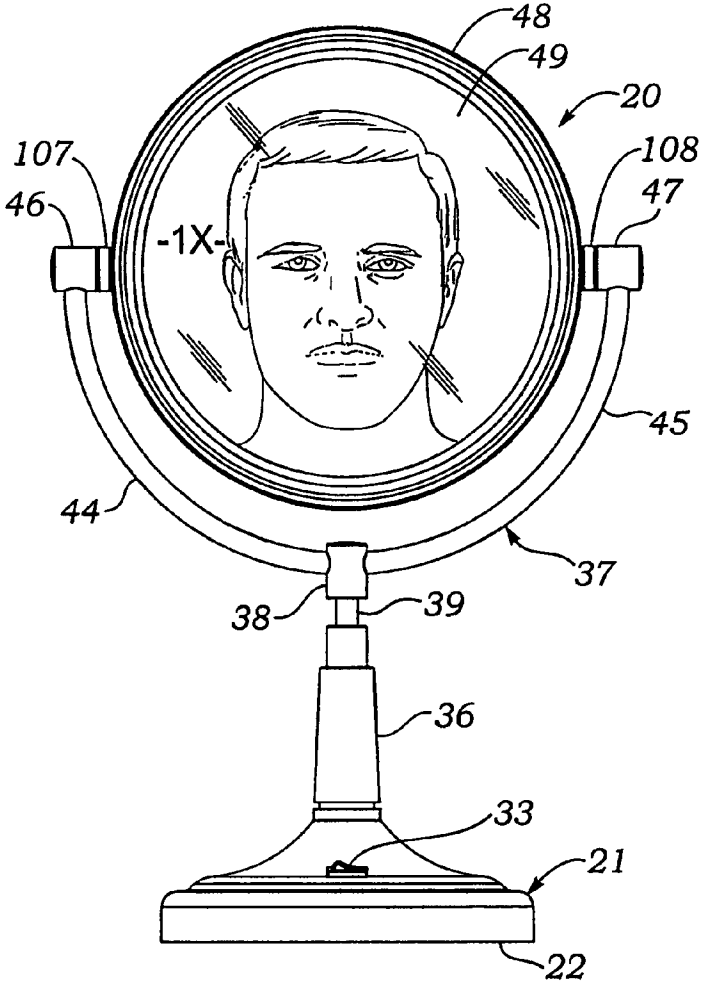
FIG. 2 is a front elevation view of an illuminated continuously rotatable dual magnification mirror according to the present invention.
Figure 1:
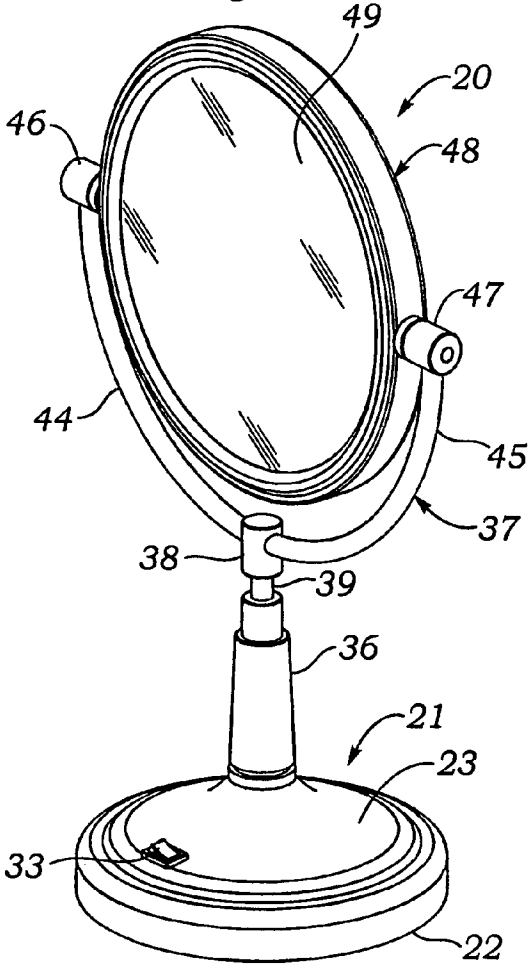
FIG. 1 is a front perspective view of an illuminated continuously rotatable dual magnification mirror according to the present invention.
Figure 4:
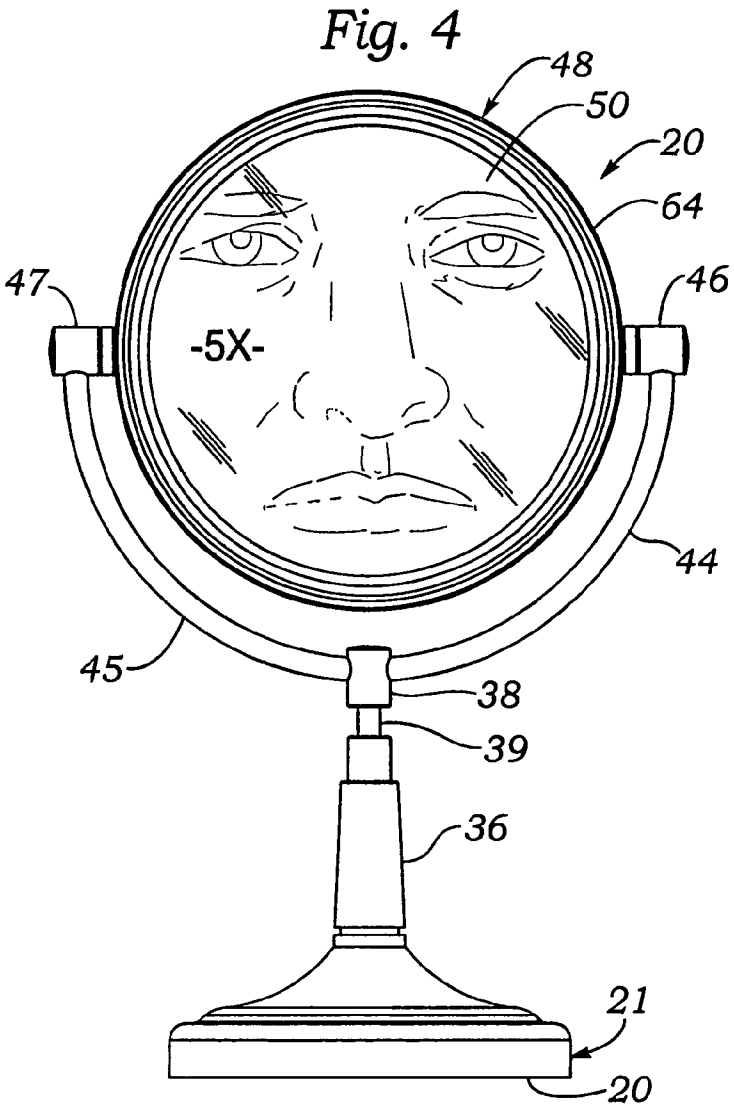
FIG. 4 is a rear elevation view of the mirror of FIG. 1, showing a rear reflective plate thereof removed.

As may be seen best by referring to FIGS. 1 and 9, mirror 20 includes a mirror frame support yoke 37 which protrudes upwardly from an upper end of the stanchion 36. As shown in the figures, yoke 37 has generally the shape of an elongated uniform circular cross-section hollow rod or tube which is curved into a downwardly concave, semicircular arc having attached to the lower central portion thereof a downwardly depending, cylindrically-shaped, construction and has at the lower end thereof a reduced diameter neck or stem 39 which is retained within a bore 40 disposed vertically through stanchion 36.

Figure 5:
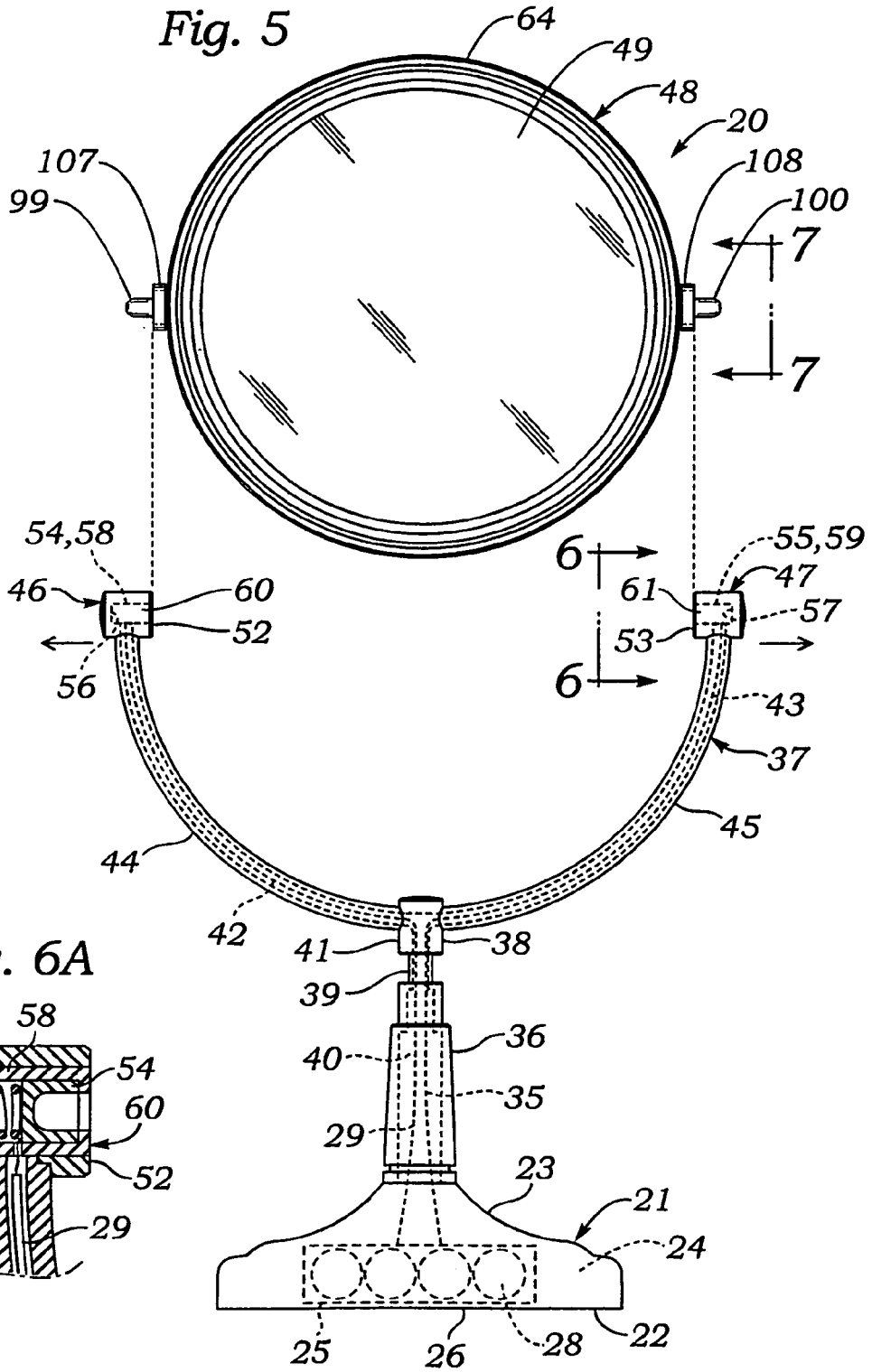
FIG. 5 is a fragmentary rear perspective view of the mirror of FIG. 4, showing a mirror housing thereof removed from the base thereof.

As may be seen best by referring to FIGS. 5 and 9, yoke support boss 38 of mirror 20 has disposed vertically therethrough a coaxial bore 41 which communicates at lower end thereof with bore 40 through stanchion 36. As is also shown in those figures, bore 41 disposed through central yoke support boss 38 communicates at an upper end thereof with a pair of left and right bores 42, 43 disposed coaxially through left and right quadrant arc-shaped arms 44, 45 of yoke 37.

Figure 6A:
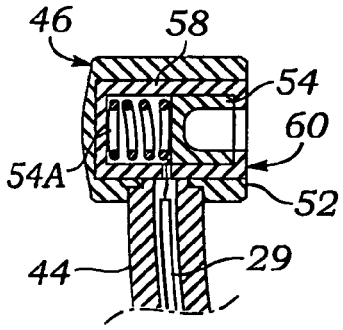
FIG. 6A is a fragmentary vertical sectional view of a left-hand boss of the mirror of FIG. 5.
Figure 7:
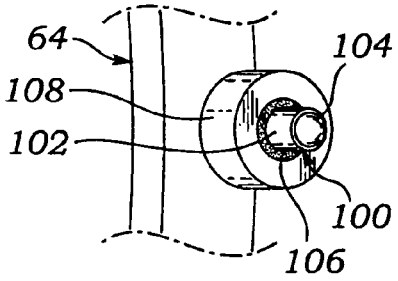
FIG. 7 is a fragmentary outer side elevation view of the mirror housing of FIG. 5, taken in the direction 7-7.
Figure 6:
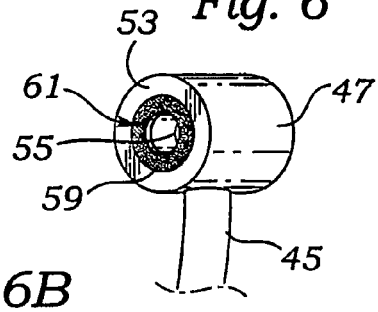
FIG. 6 is a fragmentary inner side elevation view of the mirror of FIG. 5, taken in the direction 6-6.
Figure 8:
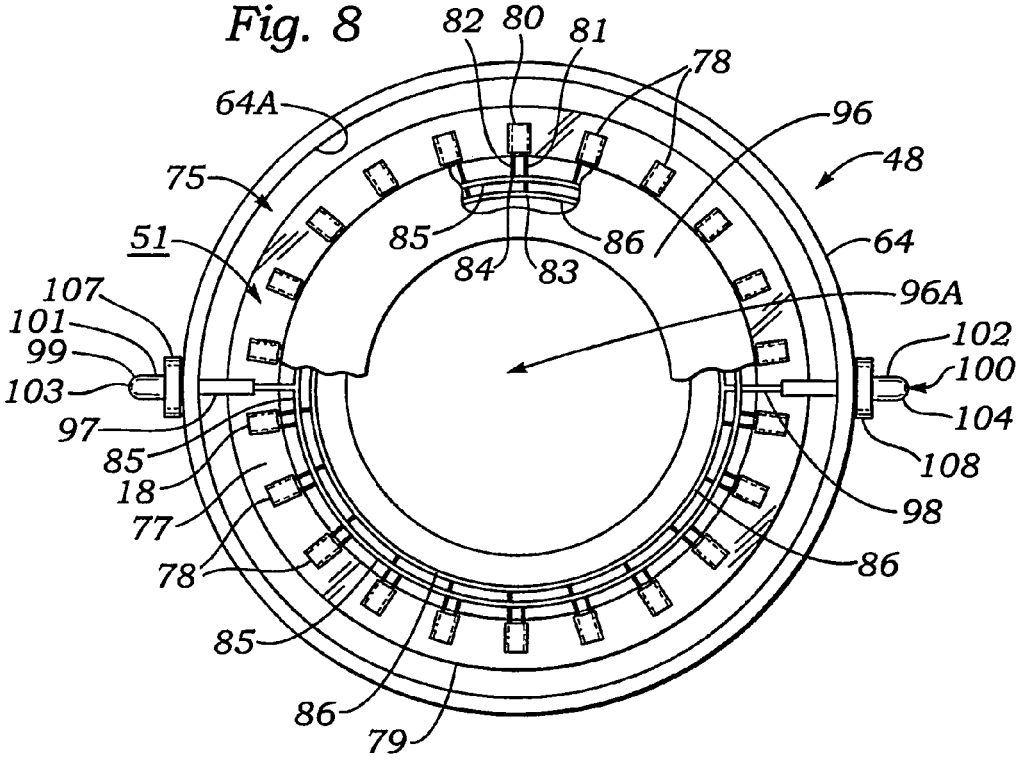
FIG. 8 is a fragmentary view of the mirror of FIG. 5, showing a rear reflective plate thereof removed from the housing.

Referring to FIGS. 5, 6 and 9, it may be seen that mirror 20 includes a pair of left and right pivot support bosses 46, 47 located at upper ends of left and right yoke arms 44, 45 respectively. Bosses 46, 47 rotatably support a mirror assembly 48 which holds an annular ring-shaped frame 64 that holds therein a pair of back-to-back mirror plates 49, 50 which have different magnification factors, e.g., 1× and 5×. As shown in FIGS. 8 and 9, mirror frame 48 has therewithin an illumination source 51 which is effective in illuminating object fields in front of both mirror plates 49, 50. The structural and functional details of mirror 20 which enable pivot support bosses 46, 47 to continuously rotatably support mirror assembly 48 while supplying electrical power to illumination source 51 are described below.

Referring to FIGS. 5-9, it may be seen that left and right frame pivot support bosses 46, 47 are of similar construction, each having extending axially from an inner transverse end face 52, 53 thereof a coaxial conductive bearing cup 54, 55, respectively. As shown in the figures, each bearing cup 54, 55 has a generally tubular cylindrical shape which is terminated at a transverse end thereof by a concave, generally hemispherically shaped end wall 56, 57, respectively. Each bearing cup 54, 55 is made of an electrically conductive material, and is in electrically conductive contact with a separate insulated electrical power lead, i.e., common power lead 29 and switched power lead 35.

As shown in FIG. 5, common power lead 29 and switched power lead 35 are disposed upwardly from battery holder 25 and switch 33 in the hollow interior space 24 of base leads 29, 35 extending upward from bore 41 through yoke support boss 38 are routed separately through bore 42 through left-hand yoke arm 44 to connect an electrically conductive contact with left-hand bearing cup 54, and through bore 43 through right-hand yoke arm 45 to connect in electrically conductive contact with right-hand bearing cup 55.

Figure 6B:
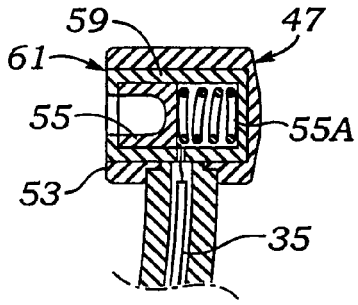
FIG. 6B is a fragmentary vertical sectional view of a right-hand boss of the mirror of FIG. 5.

In a preferred embodiment of mirror 20, yoke 37 and pivot support bosses 46, 47 are made of metal. With this construction, structure must be provided to prevent the metal yoke arms from forming a short circuit between electrically conductive bearing cups 54, 55. Thus, as shown in FIGS. 5 and 6, the conductive bearing cups 54, 55 are mounted coaxially within hollow cylindrically-shaped insulator bushings 58, 59 fitted within coaxial bores 60, 61 which extend inwards into pivot support bosses 46, 47 from transverse faces 52, 53 thereof. As may be seen best by referring to FIGS. 6A and 6B, an inner transverse end of each bearing cup, such as bearing cup 54, is urged resiliently outwards within its supporting boss 46 by a compression spring 54A.

The structure of mirror assembly 48, and its functional interaction with other components of mirror 20, may be best understood by referring to FIGS. 1-10.

Referring now to FIGS. 2,4 and 5-10, it may be seen that annular ring-shaped frame 64 of mirror assembly 48 has inwardly protruding front and rear annular peripheral flanges 65, 66, which bear against front and rear peripheral edges 67, 68, respectively of front and rear mirror plates 49, 50 to thus retain the mirror plates within the frame.

As may be seen best by referring to FIGS. 1,4, 8, 9 and 10, front and rear mirror plates 49, 50 are circularly-shaped and have central outwardly facing circularly reflective surfaces 69, 70, respectively, which occupy a substantially large portion of the diameter of the mirror plates. As is also shown in the figures, front and rear mirror plates 49, 50 have narrow outer peripheral annular ring-shaped window bands 71, 72 which encircle the central reflective surfaces 69, 70, respectively. Window bands 71, 72 are light transmissive, and preferably made of a transparent material which has a frosted inner facing surfaces 73, 74 so that light passing through the window bands is diffused. Also, as shown in FIG. 9, inner surfaces 73, 74 of diffusely transmitting of bands 71, 72 have a beveled shape, so that the outer circumferential edges of the bands are thinner than the inner circumferential edges of the bands.

Figure 10:
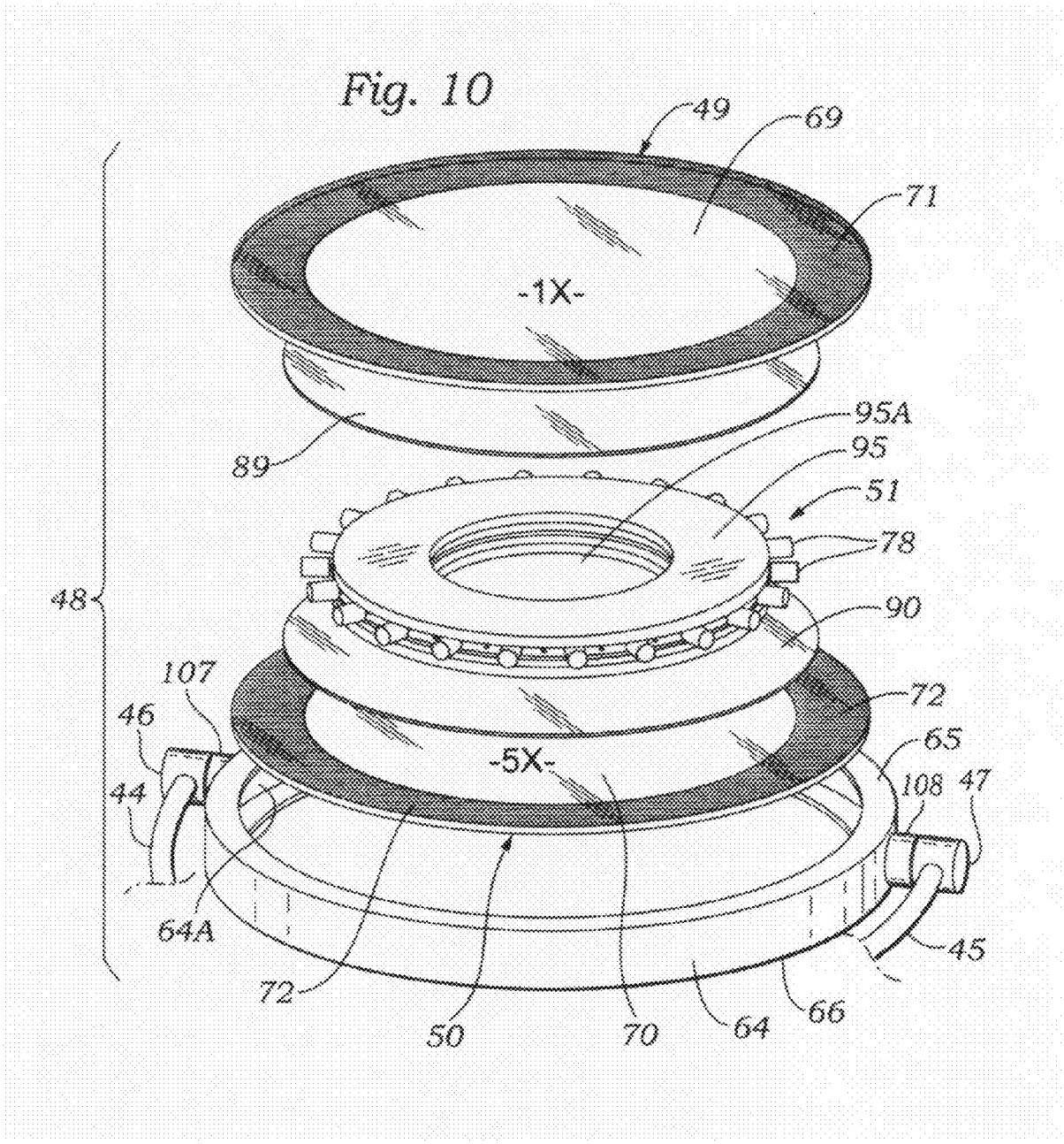
FIG. 10 is a fragmentary exploded perspective view of the mirror of FIG. 1, showing another view of a mirror assembly thereof.
Figure 12:
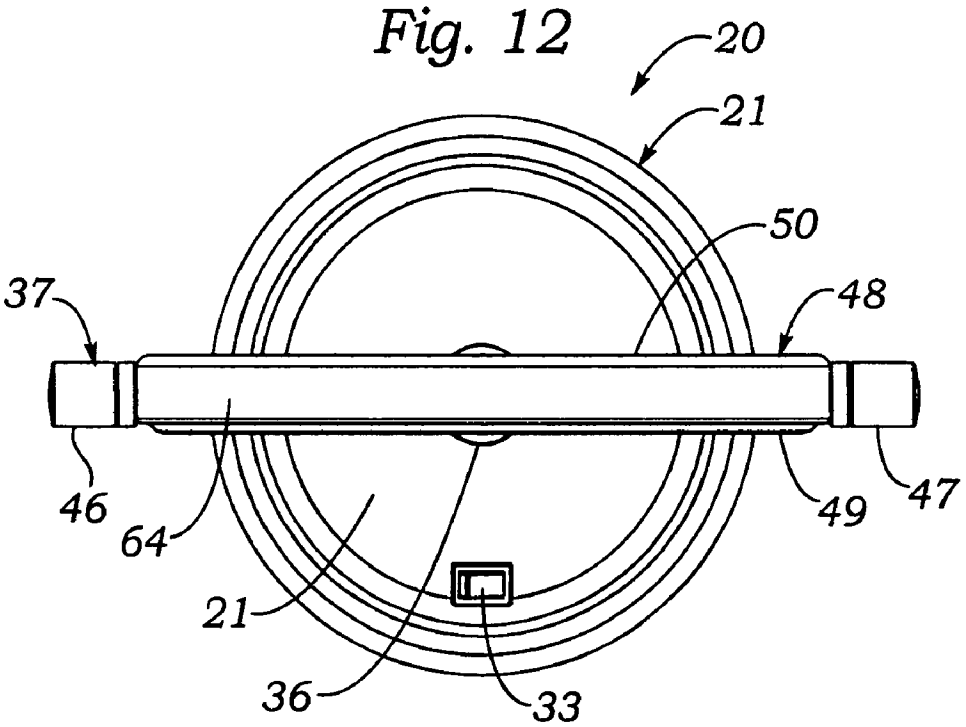
FIG. 12 is an upper plan view of the mirror of FIG. 1.

Referring to FIGS. 8-10, it may be seen that frame 64 of mirror assembly 48 has a circular disk-shaped interior space 75 which has therewithin a circular disk-shaped illumination source 51. As shown in the figures, illumination source 51 includes a thin, flat, annular ring-shaped printed circuit board 77. Printed circuit board 77 has mounted thereto a plurality of white-light emitting diodes (LED's) 78 which protrude radially outwardly of the outer circular circumferential edge wall 79 of the printed circuit board. In an example embodiment of mirror 20, each LED 78 had a cylindrically-shaped body 80, and a pair of conductive leads 81, 82 which protruded rearwardly from the body. Rear ends of conductive leads 81, 82 were bent at ninety degree angles relative to front portions of the leads, and inserted into and soldered to electrically conductive eyelets 83, 84 which were electrically continuous with a pair of outer and inner circular ring-shaped conductive foils 85, 86 arranged concentrically on printed circuit board 77. In the example embodiment 22 white-light emitting diodes 78 spaced at equal circumferential intervals of about 16 degrees were used.

Referring to FIGS. 8 and 10, it may be seen that inner facing central circular portions of mirror plates 49, 50 preferably have reflective surfaces 89, 90. The function of the inner facing reflective surfaces is to reflect light emitted by LED's 78 obliquely towards opposite window bands 72, 71, thus increasing the illumination intensity of objects in front of mirror plates 49, 50. To increase the transfer efficiency of light emitted by LED's 78 through annular mirror window bands 71, 72, outer annular edge portions 91, 92 of reflective surfaces 89, 90 are preferably angled in the same sense as the beveled inner annular edges of mirror plates 49, 50. In an example embodiment of mirror 20, reflective surfaces 89, 90 consisted of thin circular sheets of specularly reflective aluminized Mylar adhered to inner facing surfaces 93, 94 of front and rear mirror plates 49, 50.

Referring still to FIGS. 8-10, it may be seen that mirror assembly 48 includes a pair of front and rear circular disk-shaped insulating spacers 95, 96 which are adhered to which may for example be made of a foam board, i.e., a thin sheet of pasteboard to which is laminated a thicker lamination made of a high density polymer foam, preferably have central aperture 95A, 96A to provide clearance for inner facing surfaces of mirror plates 49, 50.

Figure 13:
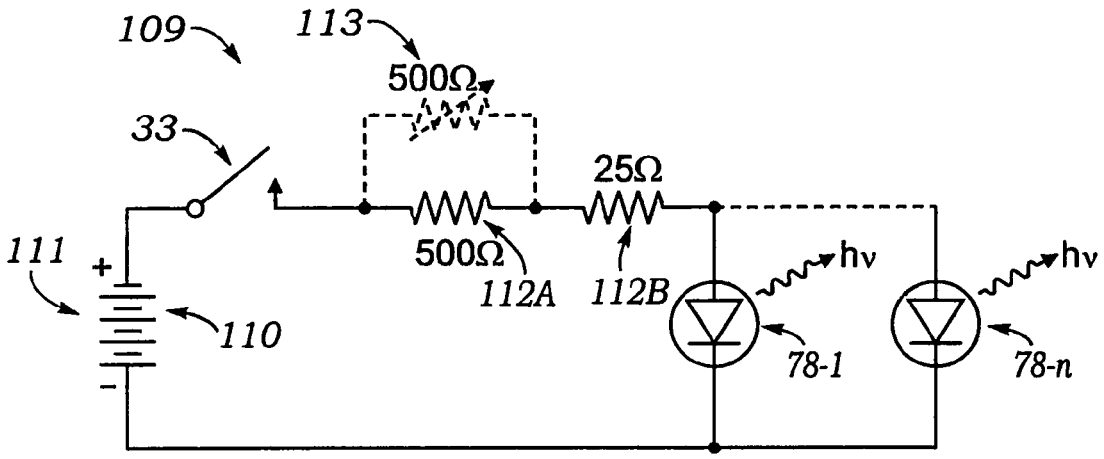
FIG. 13 is an electrical schematic diagram of the mirror of FIG. 1.

As may be seen best by referring to FIGS. 8, 10 and 13, LED's 78 are wired in parallel to conductive foils 85, 86 on printed circuit board 77. Also, conductive foils 85, 86 are connected by wires 97, 98 to a pair of horizontally disposed electrically conductive pivot pins 99, 100 which protrude radially outwardly from opposite sides of mirror frame 64. As may be seen best by referring to FIGS. 6 and 8, pivot pins 99, 100 have a generally cylindrical body 101, 102 and an outer transverse end face 103, 104 which has a convex, arcuately curved shape similar to that of the concave inner end walls 56, 57 of pivot support bearing cups 54, 55. As shown in FIGS. 6 and 8, pivot pins 99, 100 are electrically isolated from frame 64 by coaxial insulated bushings 105, 106, respectively, which protrude from bosses 107, 108 that protrude laterally outwards from opposite sides of the frame. With this construction, applying radially outwardly directed tension forces to left and right yoke arms 44, 45 of mirror 26, as shown in FIG. 5, enables mirror assemble 48 to be inserted downwardly into the yoke, until left and right pivot pins 99, 100 are axially aligned with left and right bearing cups 54, 55, respectively. Removing the tensioning forces causes the elastically deformed yoke arms 44, 45 to move radially inwards, thus rotatably retaining the pins within their respective bearing support cups.

FIG. 13 is an electrical schematic diagram of electrical circuitry 109 of mirror 20. As shown in FIG. 13, circuitry 109 includes a battery power supply 110 containing for example, 4 A-A batteries 111 connected in series. Circuitry 109 includes ballast resistors 112A, 112B in series with battery power supply 110 and LED's 78, to limit current through the LED's to a predetermined value. Optionally, a fixed ballast resistor 112A may be replaced with a rheostat or potentiometer 113 which has a manually variable resistance, thus enabling adjustability of the current through and hence light output from LED's 78.

Figure 3:
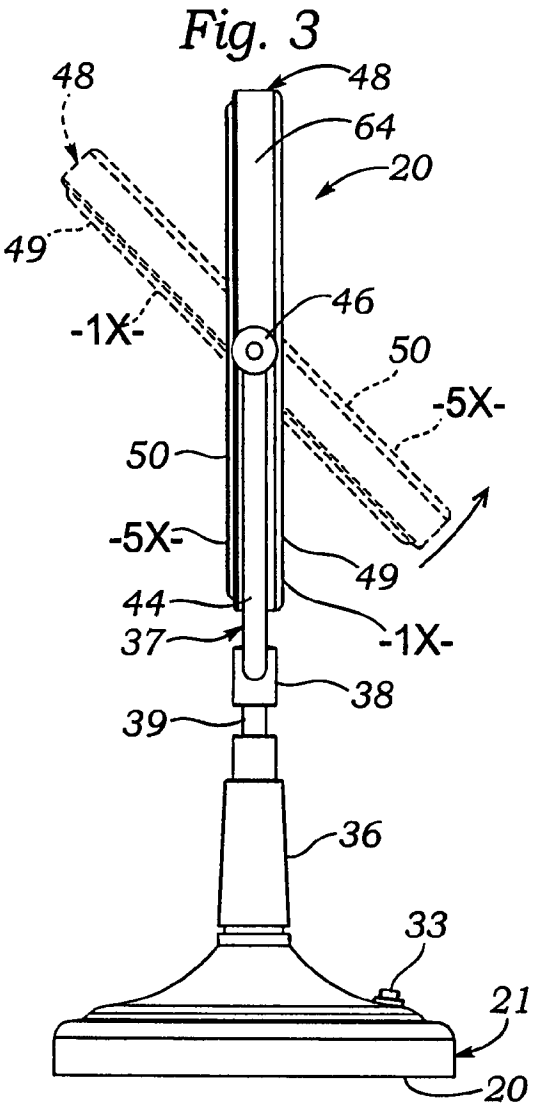
FIG. 3 is a side elevation view of the mirror of FIG. 1.
Figure 9A:
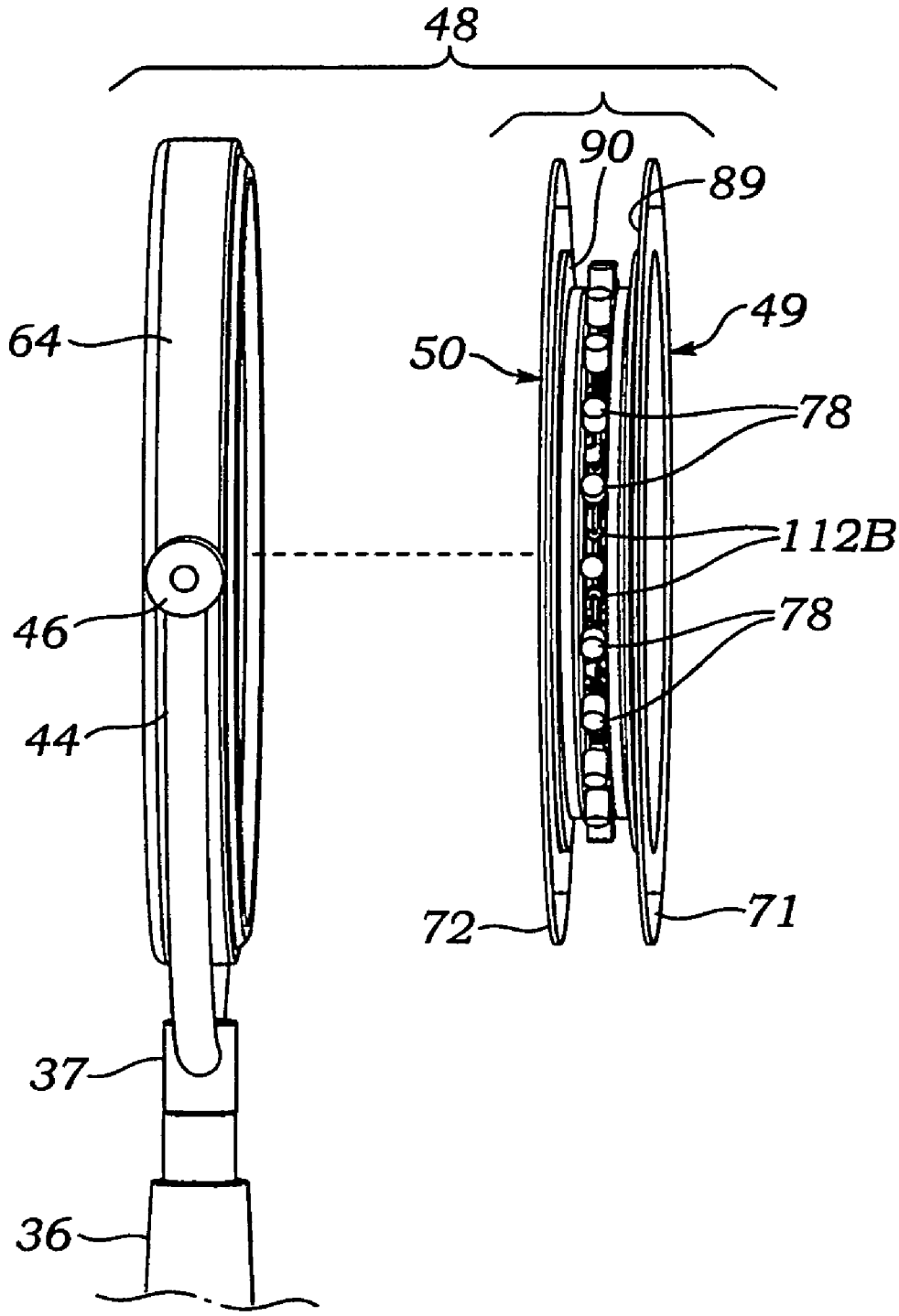
FIG. 9A is a view similar to that of FIG. 9, but showing a mirror assembly thereof in assembled form.

As may be best understood by referring to FIGS. 3 and 9A, the use of an source for mirror 20 enables mirror assembly 48 to have a minimum thickness, scarcely more than that of a non-illuminated mirror using a pair of back-to-back concave and flat mirror plates. Thus, the novel construction of mirror 20 enables it to have a more compact, space and materials conserving envelope than prior art illuminated mirrors.

Also, as shown in FIG. 9A, the arrangement of radially oriented LED's 78 in an annular ring-shaped configuration according to the present invention facilitates positioning the LED's at an optimum distance from the inner edge of the peripheral light transmissive window bands 71, 72 of mirror 20, such that light rays emitted rearward from LED's 78 are reflected forwards from rear inner reflective surface 90 through front window band 71, and rays emitted forward from the LED's are reflected rearwards from front inner reflective surface 89 through rear window band 72.

Preferably, as shown in FIGS. 8 and 10, the inner circumferential surface 64A of mirror frame 64 has a light reflecting characteristic which is effective in reflecting and thus redirecting light rays emitted from the outer transverse ends of LED's 78 to forwardly and rearwardly directed directions which are capable of being transmitted through window bands 71,72 and thereby effective in illuminating object fields adjacent to the window bands. Thus surface 64A is flat or convex and has a diffusely reflecting characteristic, or is convex and has a specularly reflective characteristic.

FIGS. 14 and 15 illustrate in more detail the flat annular ring-shaped illumination source 51. As shown in FIGS. 14 and 15, illumination source 51 includes a thin, flat annular ring-shaped printed circuit board 77 which has an inner circular peripheral edge wall 115 and a coaxial outer circular peripheral edge wall 116. As shown in FIG. 15 each LED 78 is mounted to printed circuit board 77 by two parallel conductive leads which protrude perpendicularly downwards from the base of the cylindrically-shaped body 122 of the LED. The two conductive leads of each LED 78 consist of a positive lead 117 connected to the anode of the LED and a negative lead 118 connected to the cathode of the LED. Leads 117, 118 of each LED are inserted downwards into conductive eyelets 119, 120 on the upper surface 121 of each LED 78 in radially disposed orientations, parallel to the upper surface 123 of the board, thus arranging the body of each LED to protrude radially outwards from the outer peripheral edge wall 116 of the printed circuit board.

As is also shown in FIG. 15, ballast resistors 112B are mounted parallel to the upper surface 123 of the printed circuit board 77, in radially disposed orientations on the board and located between pairs of LED's 78. FIGS. 16-23 illustrate an alternate embodiment 151 of illumination source 51.

Figure 16:
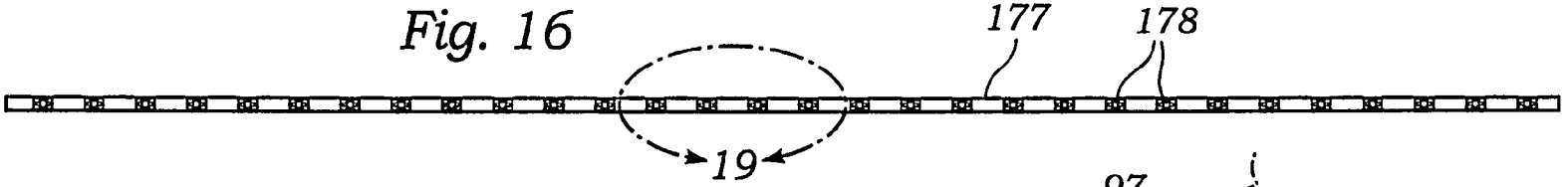
FIG. 16 is an upper plan view of a flexibly curvable printed circuit board preform for an alternate embodiment of the illumination source shown in FIGS. 8, 13 and 15, on a reduced scale.
Figure 19:
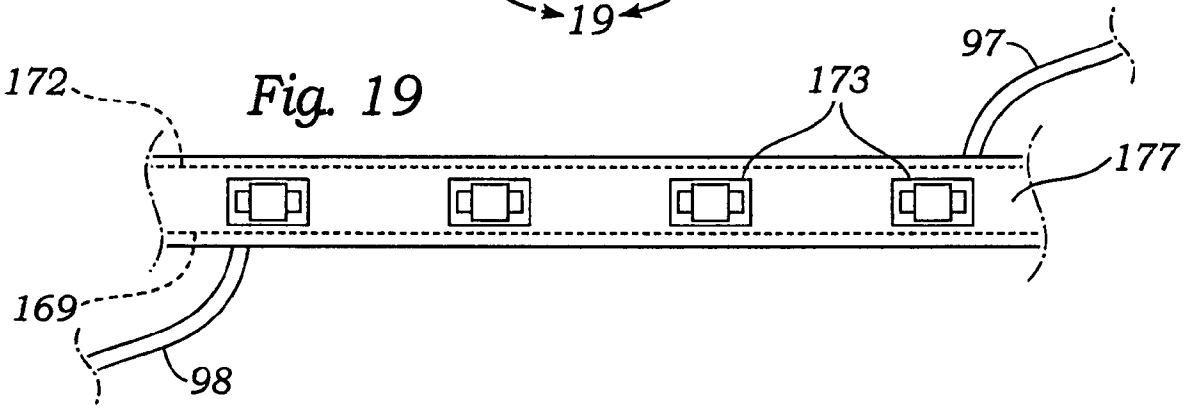
FIG. 19 is a fragmentary upper plan view of the circuit board preform of FIG. 16, on an enlarged scale.
Figure 17:
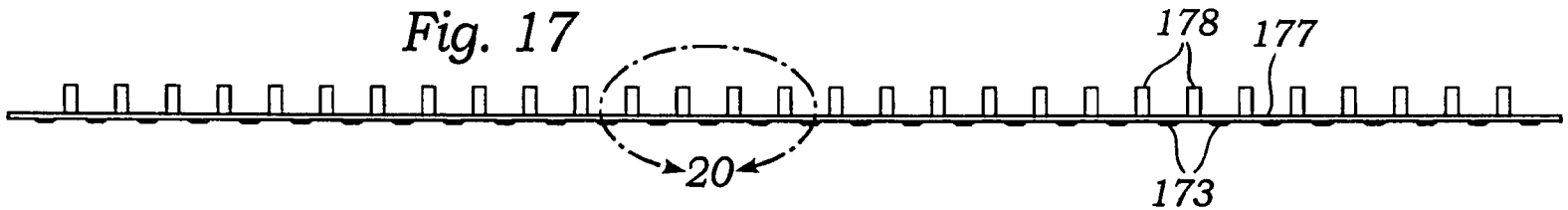
FIG. 17 is a side elevation view of the preform of FIG. 16.
Figure 20:
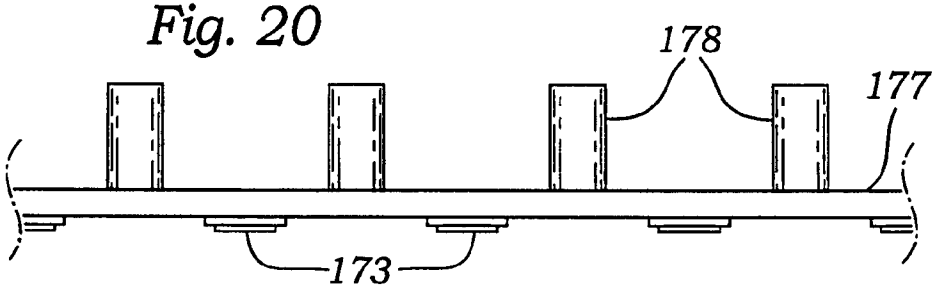
FIG. 20 is a side elevation view of the preform of FIG. 19.
Figures 18, 21:
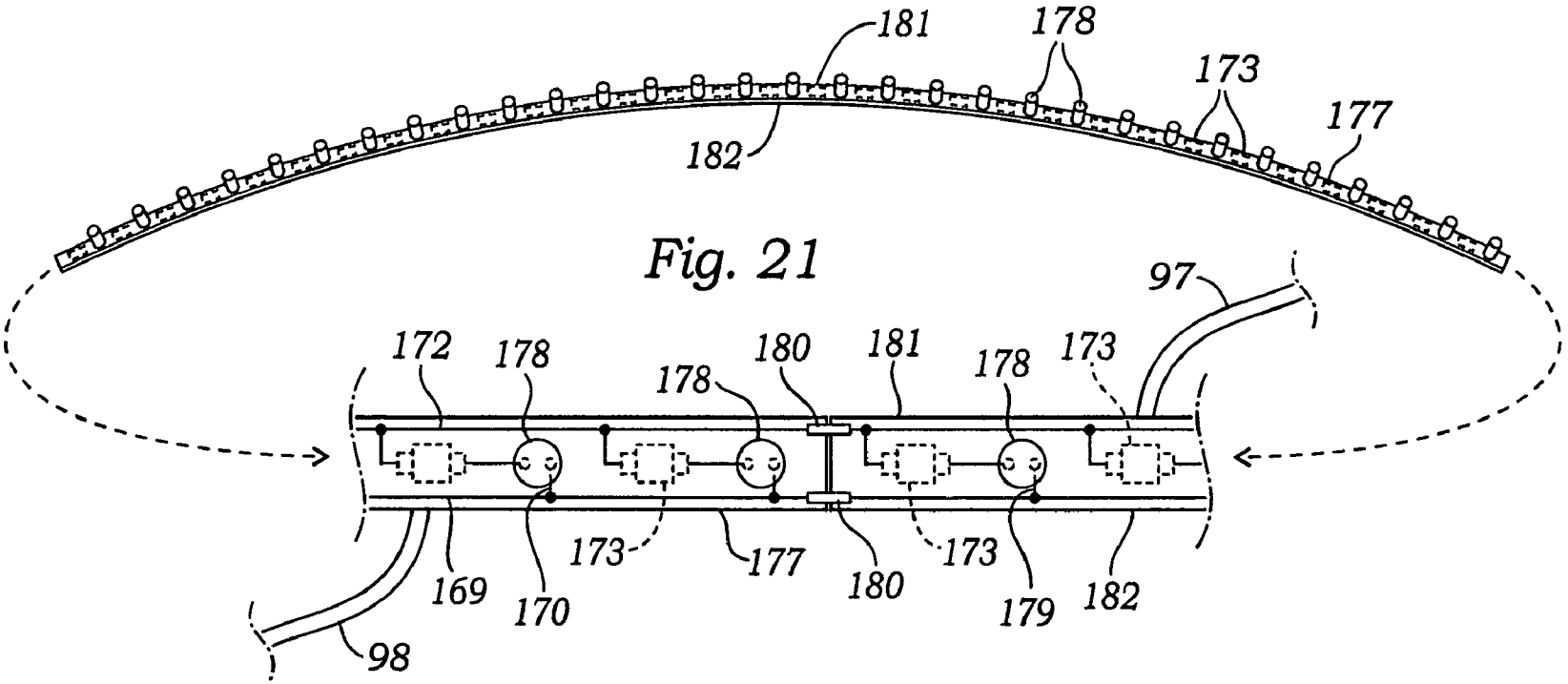
FIG. 18 is a lower plan view of the preform of FIG. 16.
FIG. 21 is a lower plan view of the preform of FIG. 19.

As shown in FIGS. 16-18, alternate illumination source 151 for mirror 20 includes a thin, narrow flexible elongated printed circuit board (PCB) 177 made of a thin, narrow strip of an insulating PCB material such as glass filled epoxy (fiberglass) material. PCB 177 is sufficiently thin and narrow to give the PCB sufficient flexibility to be bent into closed arcuately curved ring shapes. In an example embodiment, PCB 177 was made of fiberglass-filled epoxy having a thickness of 0.03125 inch and a width of 0.125 inch.

As shown in FIGS. 16-18 and 21, PCB 177 contains a thin, longitudinally elongated, electrically conductive ground or negative potential trace 169 which traverses the length of the PCB, and is electrically conductively connected to the cathode lead 170 of each one of a plurality of equally spaced apart LED's 178 which protrude upwardly from the upper surface 171 of the PCB. PCB 177 also contains a thin longitudinally elongated, positive or elevated potential trace 172 which traverses the length of the PCB. The positive trace 172 is electrically connected to one terminal of an individual ballast resistor 173 for each LED 178, the other terminal of the resistor being electrically connected to the anode terminal 179 of the LED. Electrical power is supplied to illuminator hoop 151 by electrically conductive wires 97,98 electrically conductively coupled to traces 169,172, respectively.

As shown in FIG. 18, resistors 173, which are preferably surface-mount or thick film resistors, are mounted in a parallel alignment with a longitudinal axis of PCB 177, on the lower surface 174 of the PCB. Resistors 173 are located at regular longitudinal intervals between pairs of LED's 178.

Figure 22:
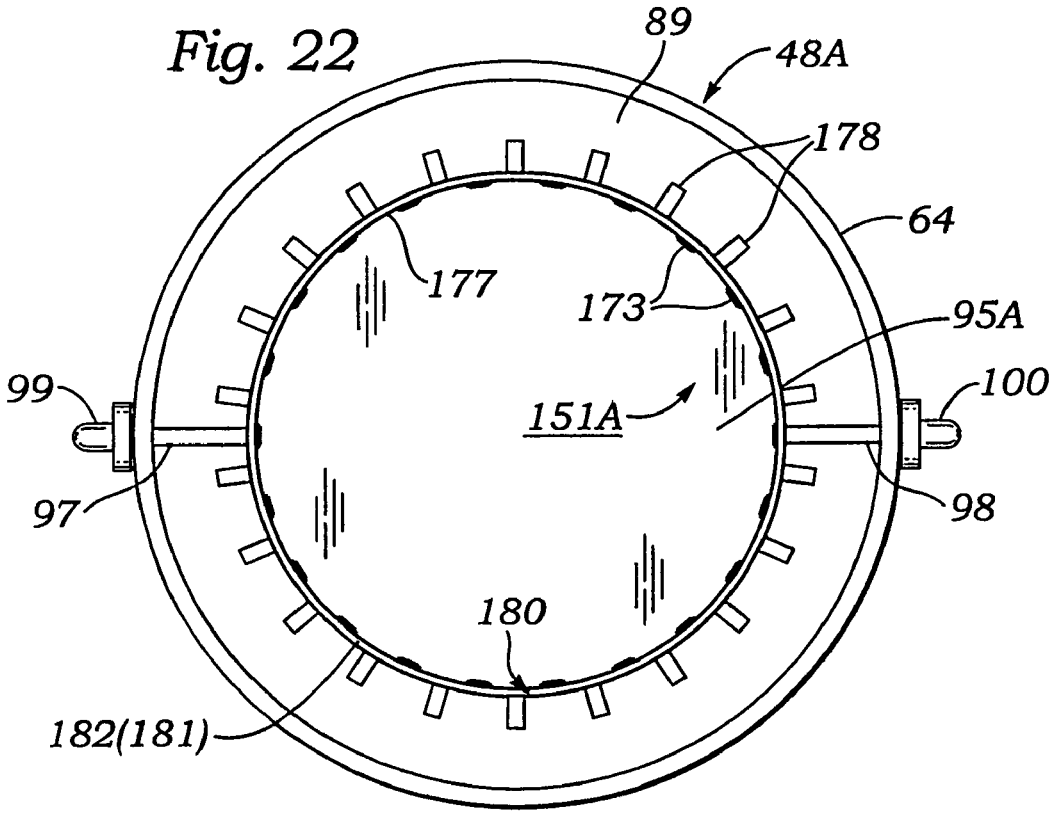
FIG. 22 is a side elevation view of an alternate illumination source for the mirror of FIGS. 1-7, in which the preform of FIGS. 16-21 has been bent into the shape of a circular hoop, opposite ends of the preform fastened together, and the illumination source installed in a circular mirror frame type shown in FIG. 8.
Figure 23:
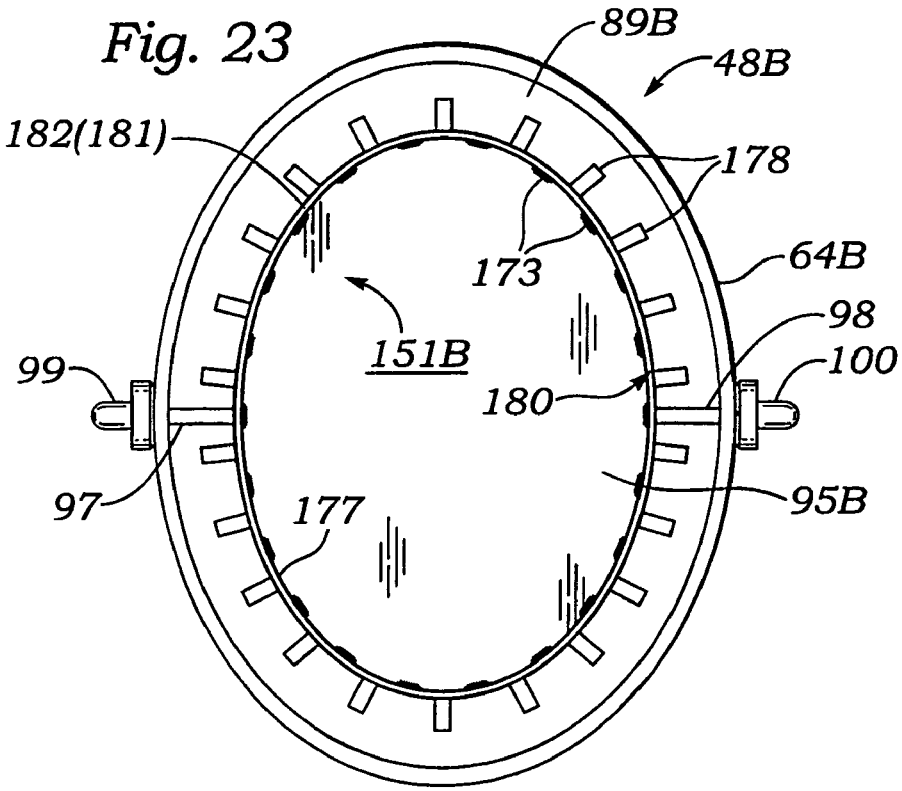
FIG. 23 is a view similar showing the preform of FIGS. 16-21 bent into an oval hoop shape and installed in an oval mirror frame which is a modification of the circular frame shown in FIG. 8.

FIG. 22 illustrates how a preform 155 consisting of the PCB 177, LED's 178, conductive traces 169, 172 and resistors 173 is formed into a ring-shaped, hoop-like illumination source 151. As shown in FIG. 22, PCB 177 is flexed into an arcuately curved hoop, and opposed transversely disposed ends 175, 176 of the PCB are then fastened to one another. The fastening can be accomplished by any suitable means, such as by one or more staples 180. The hoop-shaped illumination source 151A thus constructed is then installed in a mirror frame 48 as shown in FIG. 22, in the same manner as illumination source 51, as shown in FIG. 9.

However, in a preferred embodiment of a mirror using a flexible hoop illuminator 151, front and rear insulating annular rings 95,96, shown in FIG. 9, may be replaced by thin, circular disk-shaped insulating sheets 95A, 96A. Circular insulating sheets 95A, 96A may have the same outer diameter as annular rings 95,96, and are fastened to the front and rear reflecting surfaces 89, 90, respectively. Referring to FIG. 21 in addition to FIGS. 22 and 23, illuminator hoop 151 may be fastened to a front or rear inner facing reflective mirror surface 89 or 90 by an adhesive applied to parts or all of the front or rear transverse annular edge walls 180, 181 of illuminator hoop 151, and pressing the adhesive coated edge against front or rear insulating disks 95A, 96A. Alternatively, since front and rear annular edges 180,181 of illuminator hoop 151 do not have thereon any electrically conductive elements, insulating disks 95A,96A may be dispensed with, and illuminator hoop 151 adhered directly to a reflective surface 89 or 90. FIG. 23 illustrates how a circular hoop-shaped illumination source 151 may be deformed into a non-circular oval shape for installation in an oval mirror frame 48A.

Figure 24:
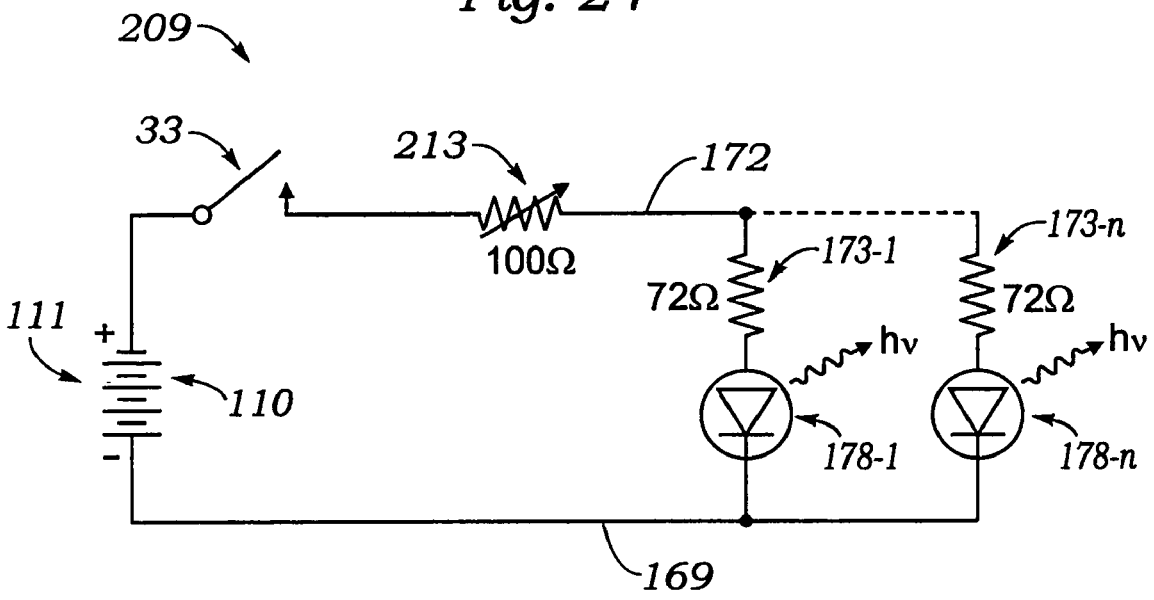
FIG. 24 is a schematic diagram of the illumination source of FIGS. 15-23, showing the source connected to power supply circuitry.

FIG. 24 is an electrical schematic diagram of the hoop-shaped illumination source 151 described above. As shown in FIG. 24, illumination source 151 is connected to an electrical power source such as a battery 110. Optionally, the connection path includes in series a potentiometer 213, thus enabling the intensity of light emitted by LED's to be manually adjusted.

As may be understood by referring to FIGS. 16-23, illuminators 151 of various circumferences may be fabricated from a preform 155 having a length equal to or greater than joining the severed transverse end with an opposed transverse end of the preform, using, for example, a pair of conductive staples, as shown in FIG. 21. Thus, one or more illuminators 151 of various sizes may be fabricated by cutting them from a single manufactured part, i.e., a sufficiently long preform 155, thus minimizing manufacturing and inventory costs.

As may be understood by comparing FIGS. 14 and 15 with FIGS. 16-21, illuminator 151 also requires a substantially smaller volume of PCB board material for its construction, providing significant cost and weight advantages.

FIGS. 25 and 26 illustrate a modification 191 of the hoop illuminator 151 shown in FIGS. 16-23 and described above. As shown in FIGS. 25 and 26, modified hoop illumination source 191 for mirror 20 includes a thin, narrow flexible elongated printed circuit board (PCB) 217 made of a thin, narrow strip of an insulating PCB material such as glass filled epoxy (fiberglass) material. PCB 217 is sufficiently thin and narrow to give the PCB sufficient flexibility to be bent into closed arcuately curved ring shapes. In an example embodiment, PCB 217 was made of fiberglass-filled epoxy having a thickness of 0.03125 inch and a width of 0.125 inch.

As shown in FIG. 26, PCB 217 contains a thin, longitudinally elongated, electrically conductive ground or negative potential trace 209 which traverses the length of the PCB, and is electrically conductively connected to the cathode lead 210 of each one of a plurality of equally spaced apart LED's 218 which protrude upwardly from the upper surface 211 of the PCB. PCB 217 also contains a thin longitudinally elongated, positive or elevated potential trace 212 which traverses the length of the PCB. The positive trace 212 is electrically connected to one terminal of an individual ballast resistor 213 for each LED 218. The other terminal of each resistor 213 is electrically conductively connected to the anode terminal 219. of an individual LED 218. Electrical power is supplied to hoop illuminator 191 by conductive wires 97,98 electrically conductively connected to traces 209,212, respectively.

As shown in FIGS. 25 and 26, resistors 213, which preferably are axial lead discrete resistors, are mounted with their n longitudinal axes disposed generally perpendicularly disposed in radially outward directions from the outer surface 214 of the PCB. Resistors 213 are located at regularly spaced, circumferentially spaced apart locations, each individual resistor being located between a pair of LED's 218.

As shown in FIGS. 25 and 16, PCB 217 is flexed into an arcuately shaped hoop, and opposite transversely disposed ends 215,216 of the PCB are then fastened together. The fastening can be accomplished by any suitable means, such as by overlapping the opposite ends of the PCB and adhesively joining overlapping surfaces of the PCB.

Modified hoop illuminator 191A may be installed in a mirror frame in the same manner as hoop illuminator 151, as shown in FIG. 22 and described above. Also, modified hoop illuminator 191A may be deformed into a non-circular, oval shape and installed in an oval mirror frame 48B, as shown in FIG. 23.

Figure 27:
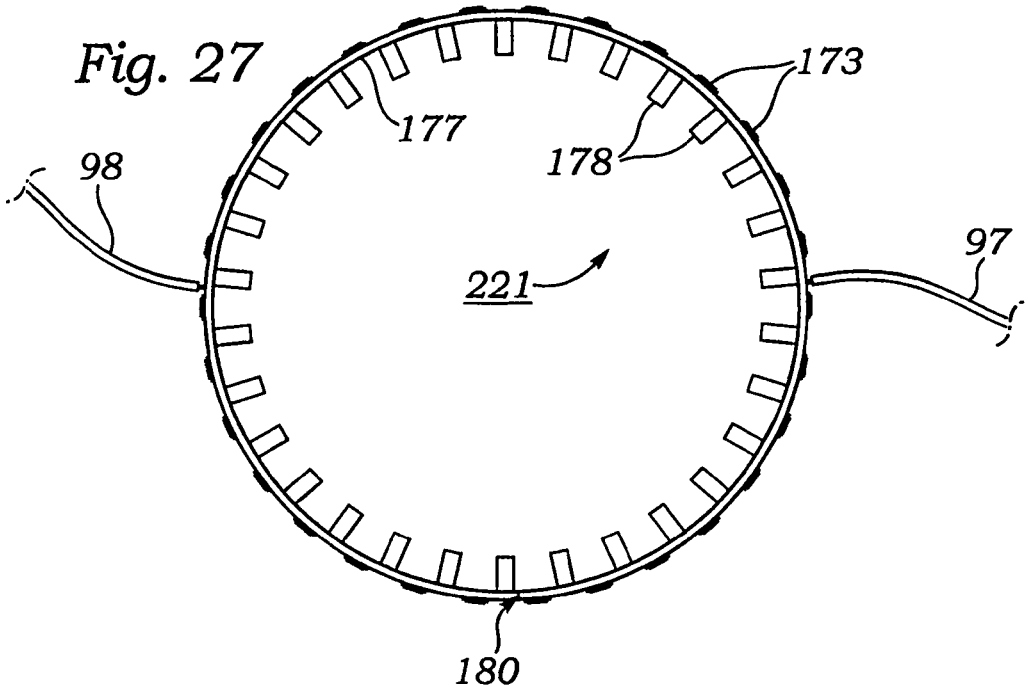
FIG. 27 is a side elevation view of a modification of the hoop illuminator of FIG. 22, in which LED light sources thereof are disposed radially inwardly rather than outwardly.

FIG. 27 illustrates a modification 221 of hoop illuminator 151A shown in FIG. 22. Modified hoop illuminator 221 may be fabricated from a printed circuit board (PCB) 177 identical in construction to the one shown in FIG. 18 and described above. However, in illuminator 221 PCB 177 is bent into a hoop shape in which the upper surface of PCB is concave rather than convex, with LED's 178 protruding radially inwards towards the center of the hoop, rather than the radially outward orientation of the LED's of illuminator 151A shown in FIGS. 18 and 22.

Figure 28:
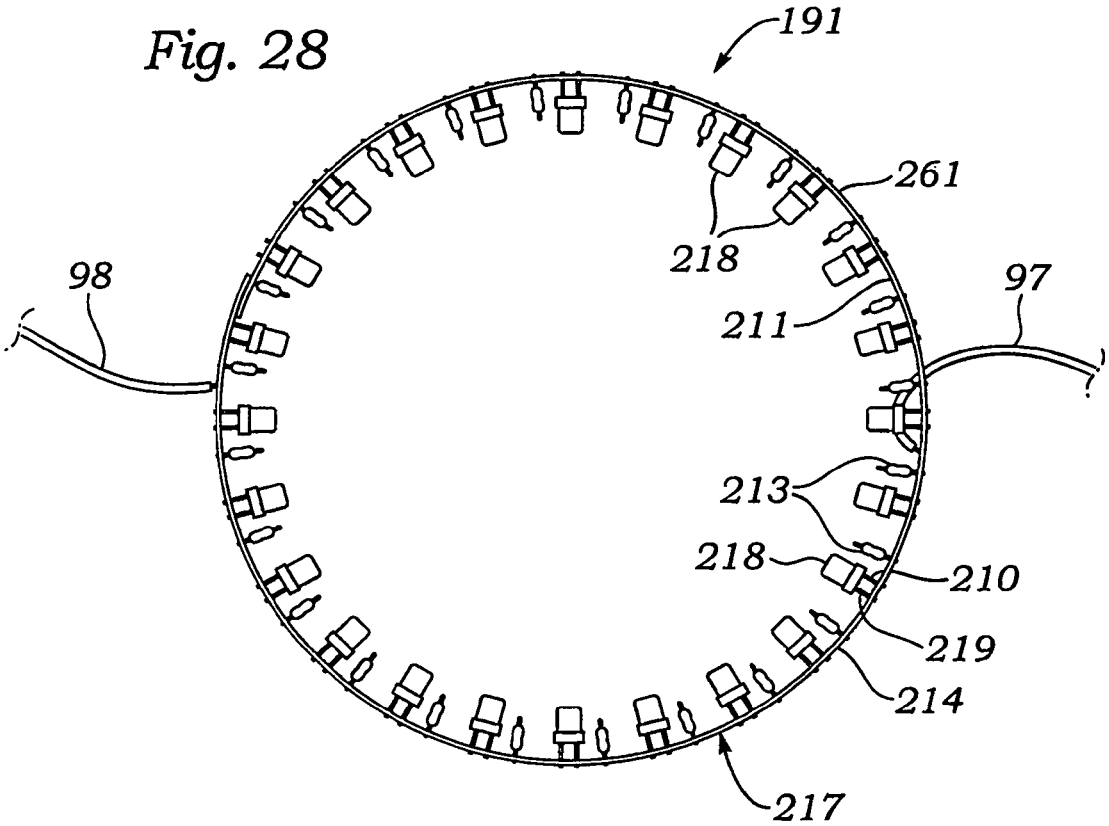
FIG. 28 is a side elevation view of a modification of the hoop illuminator of FIG. 25, in which LED light sources thereof are disposed radially inwardly rather than outwardly.

FIG. 28 illustrates a modification 261 of the hoop illuminator 191 shown in FIGS. 25 and 26. Modified hoop illuminator 261 may be fabricated from a printed circuit board (PCB) 217 identical in construction to the one shown in FIGS. 25 and 26, with the PCB bent into a hoop shape in which LED's 218 and resistors 213 protrude radially inwards towards the center of the hoop.

The modified hoop illuminators 221 and 261 with radially inwardly oriented LED's are useful in illuminating the object field of a mirror plate located concentrically within the illuminator, in an alternative construction of the mirror described above. Moreover, LED's 178 or 278 may optionally be angled either forwardly or rearwardly from a transverse center plane of the hoop illuminator 221 or 261.

As shown in FIG. 15, illuminator 51 may also be modified to orient LED's 78 in a radially inwardly protruding disposition. Thus as shown in FIG. 15, LED's 78 are installed in PCB 77 by inserting the pair of leads protruding downwards from the base of the LED into a pair of conductive eyelets, and the leads bent 90 degrees outwards to thus position the body of the LED so that it protrudes radially outwards from the outer circumferential edge 115 of PCB 77. In a modification of illuminator 51, the leads of an LED 78 may be bent 980 degrees inwards to thus position the body of the LED so that it protrudes radially inwardly of the inner circumferential edge 115 of PCB 77, as indicated by LED 78A shown in phantom in FIG. 15.

FIGS. 29-34 illustrate a modification 320 of the mirror 20 shown on FIGS. 1-7 and described above. Mirror 320 has a modified mirror assembly 348 which includes a light reflector ring 390 movably held within a frame 64. Light reflector ring 390 is longitudinally translatable within frame 64 in response to a gravitational or inertial force exerted on the ring; from a location behind illumination source 351 and adjacent to rear-facing 5× mirror plate 50 when when the mirror frame 64 is tilted to position the 1× mirror plate 49 in a forward facing use position by a person, and adjacent to rear-facing 1× mirror plate when the frame is pivoted 180 degrees to position the 5× mirror plate in a forward facing use position.

As will be described in detail below, motion of the reflector ring 390 to a location behind illumination source 351, which is longitudinally centered within frame 64, causes those light rays which are emitted rearwardly from LED's 378 of illumination source 351 to be reflected forward from a front facing surface of the reflector ring and out through the annular light diffuser window 71,72 around a front-facing mirror plate 49,50, respectively. This construction thus substantially improves the utilization of light energy emitted by the LED's 378, since otherwise wasted rearwardly directed light rays emitted by the LED's are reflected forward and out through an annular window 71 or 72 which encircles mirror plate 49, 50, respectively, unto an object such as a person's face located in front of the mirror plate.

Figure 29:
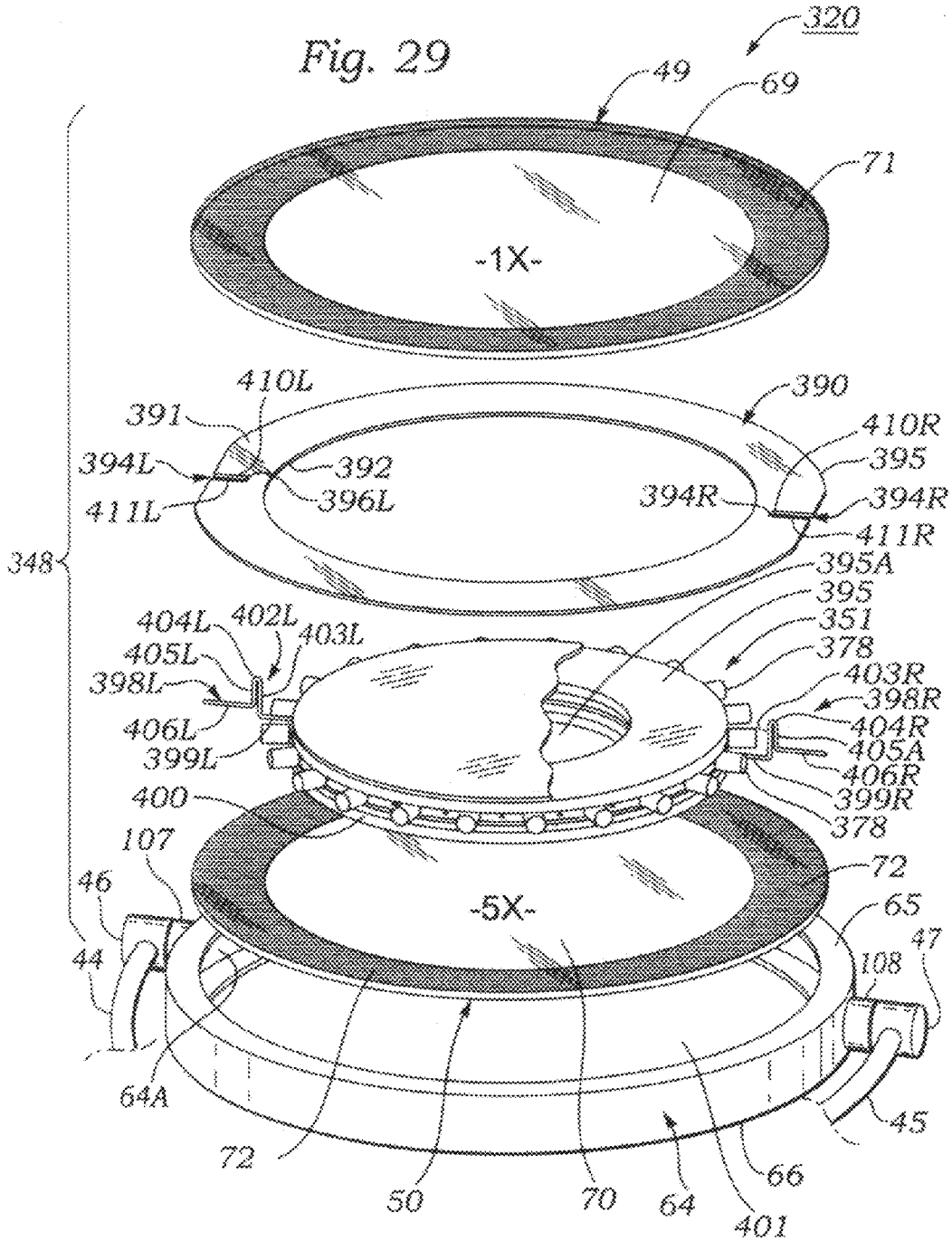
FIG. 29 is a fragmentary exploded perspective view of a modification of the mirror of FIGS. 1-26 which includes a movable reflector ring.
Figure 30:
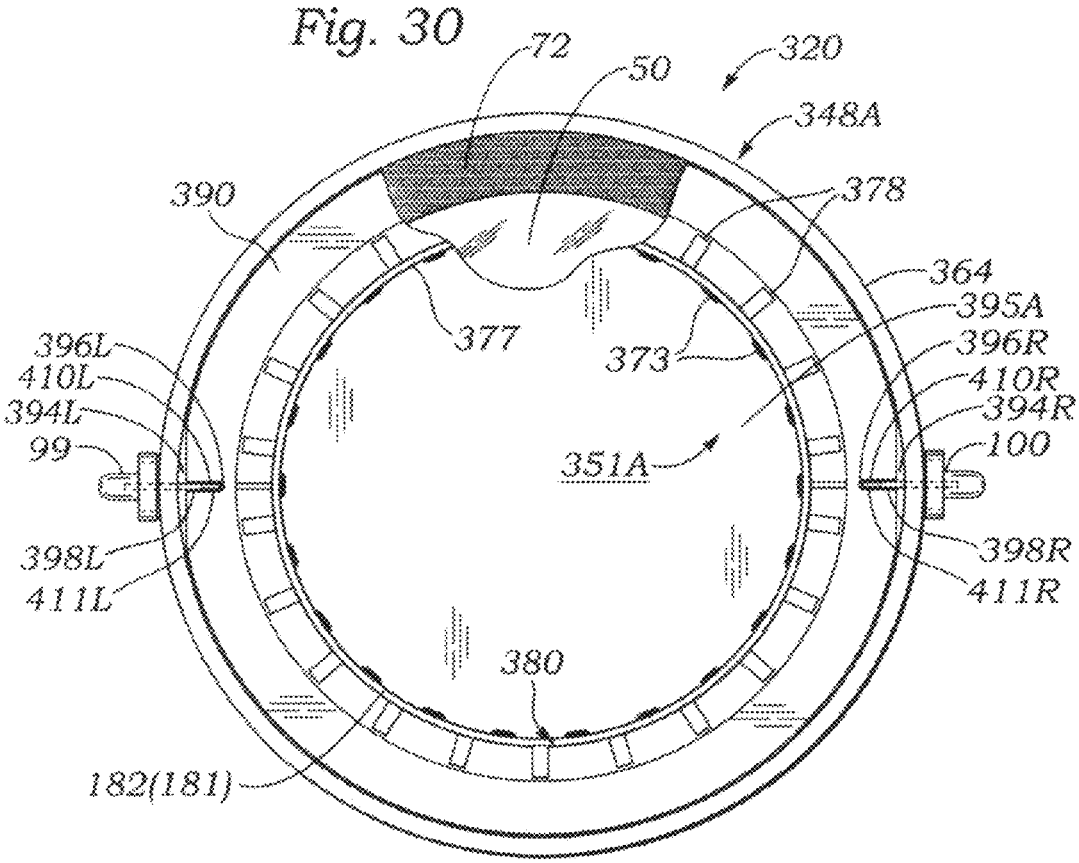
Figure 32:
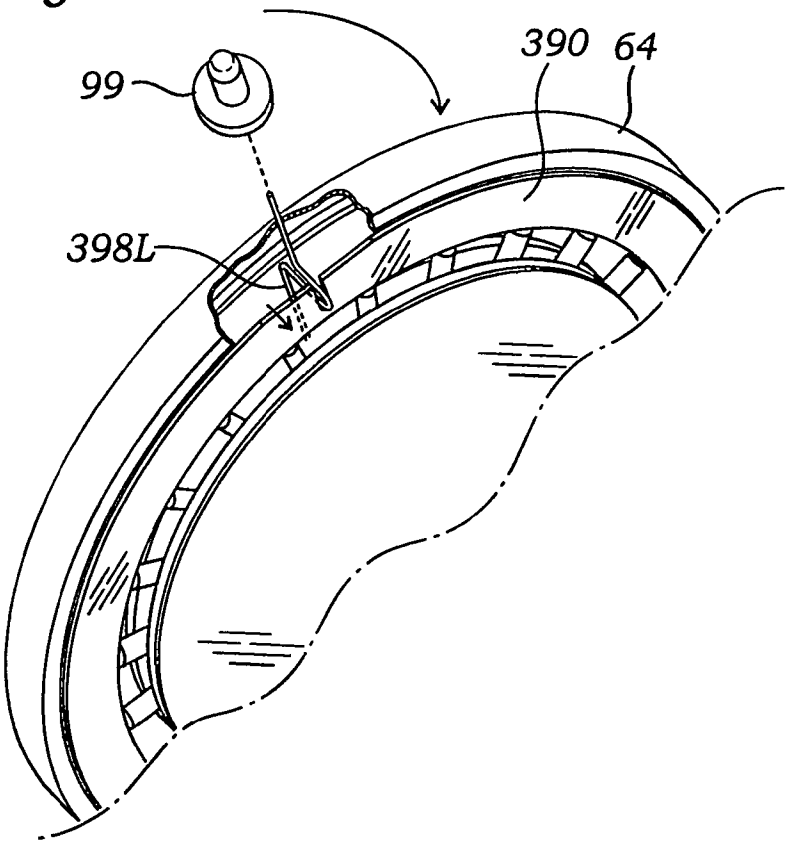
FIG. 32 is a view similar to that of FIG. 31, but showing the mirror assembly thereof rotated 180 degrees to thereby enable a reflector ring thereof move under the force of gravity to a location adjacent the 5×-magnification mirror plate to thus reflect light from the illumination source forwards through an annular diffuser window circumscribing the 1×-magnification mirror plate.
Figure 31:
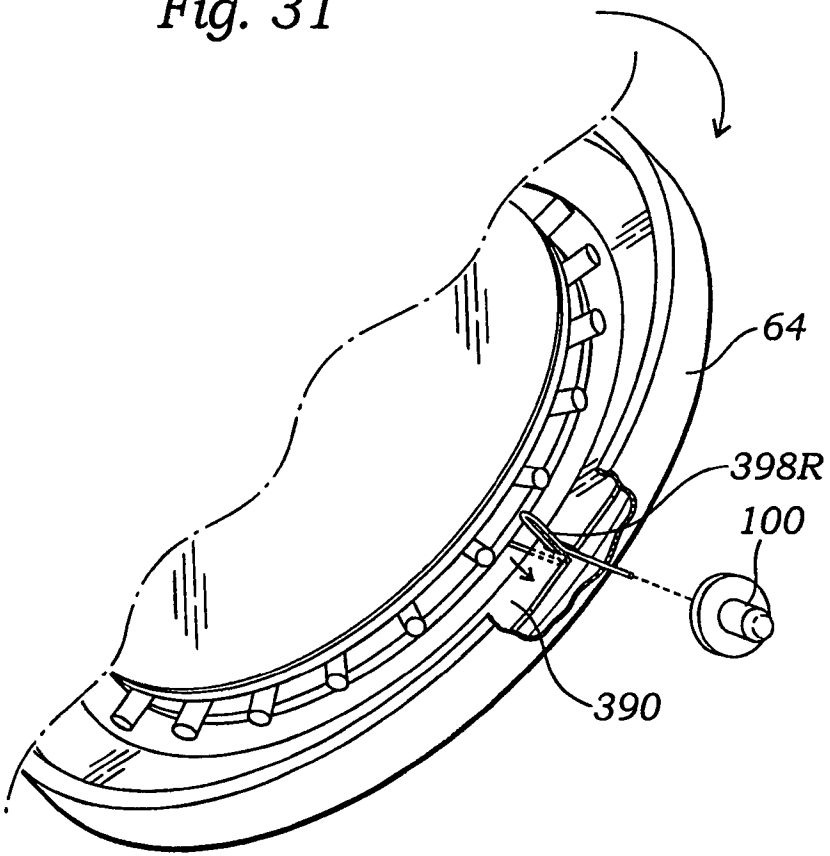
FIG. 31 is a fragmentary perspective view of the mirror of FIGS. 29 and 30, showing the mirror frame assembly thereof tilted rearwards to enable a reflector ring thereof to move under the force of gravity rearwards behind a longitudinally centered illumination source and towards a 5×-magnification mirror to thus reflect light forwards through an annular diffuser window circumscribing a 1×-magnification mirror.
Figure 34:
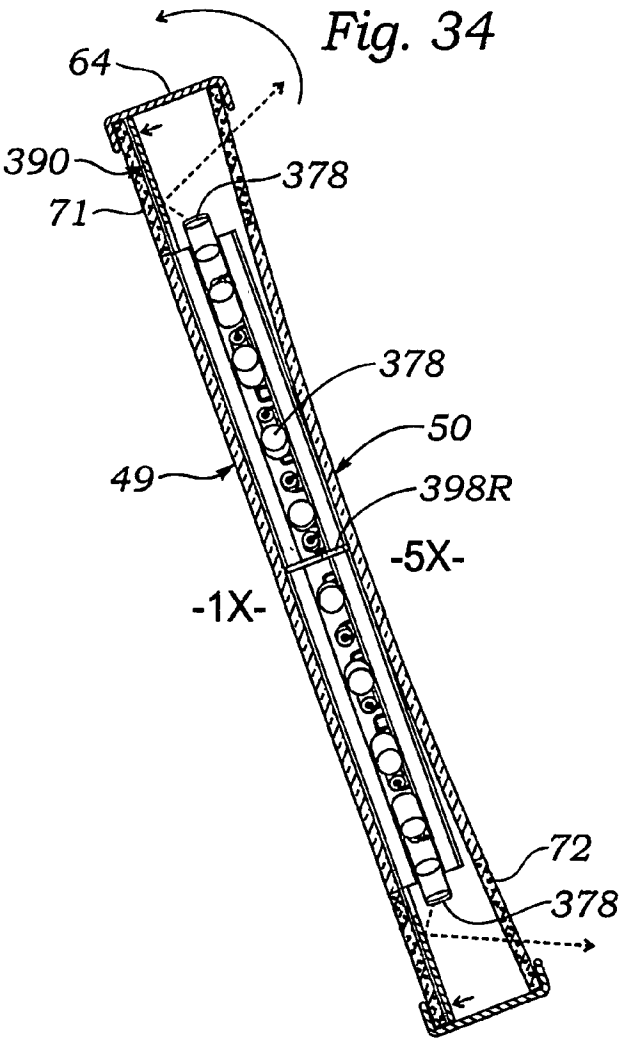
FIG. 34 is a view similar to that of FIG. 33, but showing the mirror assembly thereof rotated 180 degrees to thereby enable a reflector ring thereof move under the force of gravity to a location adjacent the 1×-magnification mirror plate to thus reflect light from the illumination source forwards through an annular diffuser window circumscribing the 5×-magnification mirror plate.
Figure 33:
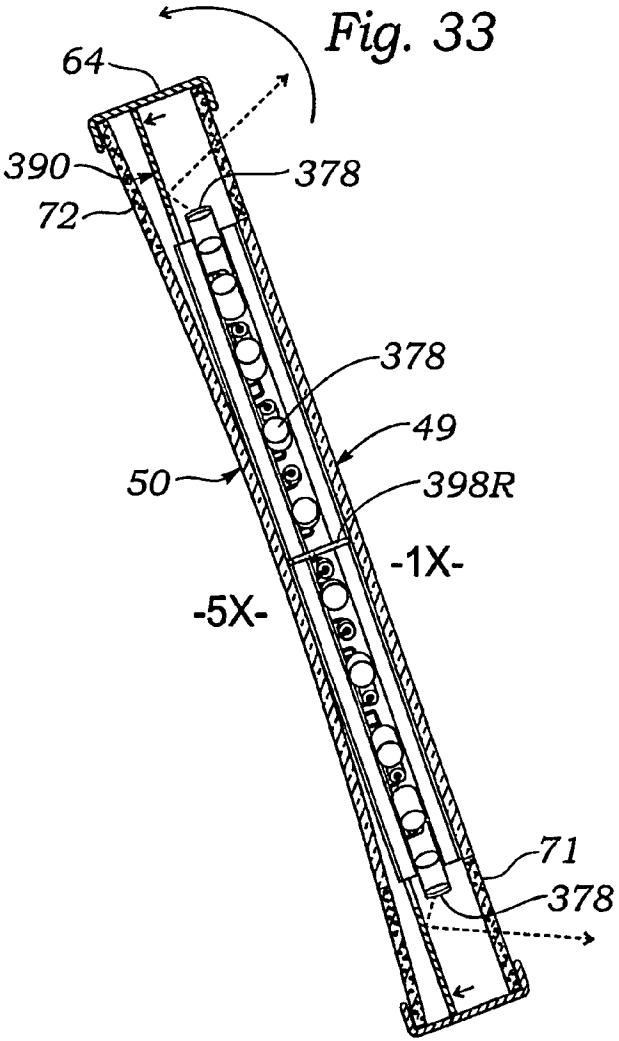
FIG. 33 is a left side sectional view of the mirror of FIGS. 29 and 30, showing the mirror frame assembly thereof tilted rearwards to enable a reflector ring thereof to move under the force of gravity rearwards behind a longitudinally centered illumination source and towards a 5×-magnification mirror to thus reflect light forwards through an annular diffuser window circumscribing a 1×-magnification mirror.

Referring now to FIGS. 29-30, it may be seen that reflector 390 has the shape of thin, flat annular ring which has an outer diameter slightly less than the inner diameter of mirror frame the outer transverse end faces of radially outwardly disposed LED's 378 of illuminator 351. Reflector ring 390 has front and rear surfaces 391, 392 which have a relatively high, preferably diffuse light reflectance, and is made of a material such as cardboard, polystyrene, PVC or the like. In an example embodiment, diffuser ring was made of 0.0625 inch-thick white polystyrene.

As may be seen best by referring to FIGS. 29 and 30, reflector ring 390 has a pair of diametrically opposed, radially elongated rectangular slots 394L, 394R which extend radially inwards from diametrically opposed left and right locations on outer circumferential edge 395 of the reflector ring. Each slot 394 terminates at an inner transversely disposed edge wall 396.

As may be understood by referring to FIGS. 29-32, slots 394 are provided to longitudinally slidably support reflector ring 390 within frame 64, as will now be described.

As shown in FIGS. 29 and 30, mirror assembly 348 of mirror 320 includes a modified illuminator 351, in which straight power conductor pins 97,98 (see FIG. 22) are replaced by modified conductor pins 398L, 398R. As shown in figure Each conductor pin 398 includes a short inner segment 399 which protrudes radially outwards from the outer circumferential edge 400 of illuminator PCB 377, in close proximity to the inner surface of one of the reflective mirror plates, such as inner surface 401 of 5× mirror plate 50.

Each conductor pin 398L, 398R has a hairpin-curve shaped intermediate section 402 located in a plane perpendicular to mirror plates 49 and 50, i.e., in a plane which is axially or longitudinally disposed from front to rear of frame 64.

Curved intermediate section 402 of conductor pin 398 has a straight segment 403 which curves perpendicularly upright from inner radial segment 399, an upper short radially outwardly disposed segment 404, and an intermediate length segment 405 which curves downwardly from upper radial segment 404. Conductor pin 398 also includes a relatively long, outer radially disposed segment 406 which extends radially outwards from the lower end of outer vertical segment 405. Outer radial segments 406L, 406R are located axially forward and generally parallel to inner radial segments 399L, 399R, and protruded radially outwards through bores centrally located within bosses 107, 108, respectively, to thus make electrically conductive contact with pivot pins 99, 100, respectively.

FIGS. 31-34 Illustrate how conductor pins 398 function as guides for reflector ring 390 and enable it to slide longitudinally between inner facing surfaces of mirror plates 49 and 50. As shown in those figures, inner transversely disposed edge wall 396 of each slot 394L, 394R in reflector ring 390 longitudinally slidably contacts the radially inwardly located vertical or axially disposed side of inner vertical segment 403 of conductor pin 398. Also, the parallel radially disposed edge walls 410, 411 of each slot 394 are spaced apart at a distance slightly greater than the diameter of wire conductor pin 398.

The foregoing construction enables free longitudinal or axial slidable movement of reflector ring 390 within frame 64, between inner facing surfaces of mirror plates 49 and 50.

FIGS. 31-34 also illustrate how the structure of mirror 320 described above enables the reflector ring 390 to move longitudinally within frame 64, in response to the force of gravity or an inertial force exerted on the frame.

As shown in FIGS. 31-34, when mirror frame 64 is pivoted to a horizontal orientation, the weight of reflector ring 390 causes it to slide downwards on guides 398 and come to rest on the inner face of a lower mirror plate, such as 5× mirror plate 50. In this location, reflector ring 390 is located behind illuminator 351, thus reflecting light rays emitted rearwardly from LED's 78 of the illuminator forward through annular window 71 surrounding 1× mirror plate 49. Thus, when frame 64 is pivoted forward to a vertical or slightly rearwardly tilted orientation, reflector ring 390 is retained by frictional contact of its outer circumferential edge 395 with the inner circumferential wall 411 of the frame at its location adjacent rear 5× mirror plate 50.

When frame 64 is pivoted 180 degrees to thus position 5× mirror plate 50 in a forward facing orientation, reflector ring 390 falls onto the inner surface of 1× mirror plate 49 to thus become effective in reflecting light rays emitted rearwardly from LED's forward trough annular window 72 surrounding the 5× mirror plate.

As may be readily understood from the foregoing description of the structure and function shaped band shown in the figures, to that of a non-circular annular ring-shaped band for use in mirror frame which has a non-circular shape, such as the oval frame shown in FIG. 23. Also, those skilled in the art of geometric optics will recognize that either or both front and rear reflective surfaces of reflector ring 390 may be modified from a flat, diffusely reflective surface as described above, to vary the reflective properties of either or both surfaces. Thus either or both front and rear surfaces of reflector ring 390 may modified by contouring or altering the texture or reflectance of those surfaces to thereby alter characteristics of light rays reflected from those surfaces and out through the windows adjacent to the front and/or rear mirror plates.

In a modification of mirror 320, slots 394 of annular ring-shaped reflector 390 may be extended radially inwards to inner circumferential edge wall 412 of the reflector ring, thus severing the ring into opposed upper and lower semi-annular reflector rings 390U, 390D. With this modification, upper radial segments 404 of hairpin-curve section 402 of conductor pins 398 are preferably lengthened to provide a longer supporting surface for the radial edges of the semi-annular reflector rings.

In another modification of mirror 20, illuminator 51 is modified by alternating axially forwardly disposed LED's connected to a first power supply bus with axially rearwardly disposed LED's connected to a second power supply bus, and includes an electrical switch which is actuated by rotation of mirror frame 64 180 degrees to power only that bus which energizes forwardly oriented LED's.

What is claimed is:

1. A mirror comprising;

a. a mirror assembly including a mirror frame holding therein at least a first reflective mirror plate, said first reflective mirror plate having a central axially outwardly facing imaging light reflective surface, said mirror assembly including a light transmissive region adjacent to said imaging reflective surface, b. an electrically energizable illumination source located within said frame axially inwardly of said light transmissive region of said first reflective mirror plate, said illumination source including an elongated, thin, narrow strip made of a flexible material including a printed circuit board bent into an arcuately curved beam having a plurality of longitudinally spaced apart light emitting diodes protruding from a curved surface of said beam, and, c. at least a first ballast resistor connected in series with each light emitting diode.

2. The mirror of claim 1 wherein said ballast resistor is mounted on a mounting surface consisting of either of an inner, concave surface and an outer convex surface of said printed circuit board.

3. The mirror of claim 2 wherein said ballast resistor is longitudinally located between a pair of adjacent light emitting diodes.

4. The mirror of claim 3 wherein said ballast resistor is disposed generally parallel to said mounting surface of said printed circuit board.

5. The mirror of claim 3 wherein said ballast resistor is disposed generally radially outwardly from said mounting surface of said printed circuit board.

6. The mirror of claim 1 wherein said arcuately curved beam is bent into a hoop shape.

7. The mirror of claim 6 wherein said hoop shape is circular.

8. The mirror of claim 6 whereas said hoop shape is oval.

9. A mirror comprising;

a. a mirror assembly including a mirror frame holding therein at least a first reflective mirror plate, said first reflective mirror plate having an axially outwardly facing imaging light reflective surface and a light transmissive region adjacent to said light reflective surface, b. an electrically energizable illumination source located within said frame axially inwardly of an axially inner facing side of said reflective mirror plate, said illumination source including an elongated, thin, narrow printed circuit board bent into an arcuately curved hoop-shaped band having a plurality of light emitting diodes protruding outwardly from an outer convex surface thereof, c. a yoke having a pair of opposed arms for rotatably supporting therebetween said mirror frame, d. an electrical power coupling mechanism for providing electrical power to said illumination source, said electrical power coupling mechanism including a pair of laterally opposed continuously rotatable electrically conductive pivot joints, each of which comprises in combination an electrically conductive pin that protrudes from one of said frame and a said yoke arm, an electrically conducive cup which supports said pin located in the other of said yoke and said frame, an internal electrical conductor disposed between one of said pin and cup and said illumination source, and an external electrical conductor disposed between the other of said cup and said pin and through a said yoke arm towards an output terminal of an electrical power source, e. a support base containing therein an electrical power supply, and f. a support structure disposed between said base and said yoke, said support structure having disposed therein a hollow tubular passageway for receiving there through a first external electrical conductor through said first yoke arm and a second external electrical conductor through said second yoke arm, said first and second external conductors being electrically conductively connectable to first and second output terminal is of said power supply.

10. The mirror of claim 9 wherein said light emitting diodes of said illumination source are further defined as being at least in part generally concentrically aligned with said light transmissive region of said first reflective mirror plate.

11. The mirror of claim 9 further including a first light reflective member located axially inwardly of said illumination source, said first reflective member having a light reflective surface facing said light transmissive region of said first reflective mirror plate.

12. The mirror of claim 11 wherein said light transmissive region of said first mirror plate is further defined as being radially outwardly beveled whereby radially outwardly located portions of said light transmissive region are thinner than a radially inwardly located portion thereof.

13. The mirror of claim 12 wherein said light transmissive region of said first reflective mirror plate is further defined as having a diffusive light transmittance.

14. The mirror of claim 13 further including a second reflective mirror plate having a central axially outwardly facing imaging reflective surface and a light transmissive region adjacent to said imaging reflective surface, said second reflective mirror plate having an axially inwardly facing inner surface.

15. The mirror of claim 14 wherein said first light reflective member is located on a reverse, axially inwardly located surface of said second reflective mirror plate.

16. The mirror of claim 15 further including a second light reflective member located axially inwardly of said illumination source, said second light reflective member having a light reflective surface facing said light transmissive region of said second reflective mirror plate.

17. The mirror of claim 15 wherein said second light reflective member is located on a reverse, axially inwardly located surface of said first reflective mirror plate.

18. A mirror comprising;

a. a mirror assembly including a mirror frame holding therein at least a first reflective mirror plate, said first reflective mirror plate having a central axially outwardly facing imaging reflective surface, and a second reflective mirror plate having an axially outwardly facing imaging reflective surface, said second mirror plate being spaced axially from said first mirror plate, said mirror assembly including first and second light transmissive regions adjacent to said first and second imaging reflective surfaces, respectively, b. an electrically energizable illumination source located within said frame axially inwardly of said light transmissive regions of said first and second imaging reflective mirror plates, c. a reflector plate having front and rear light reflective surfaces, said reflector plate being axially movably held within said frame between a first position located between said illumination source and said first reflective mirror plate to thereby reflect light emitted from said illumination source back through said light transmissive region adjacent to said second mirror plate, and a second position located between said illumination source and said second mirror plate to thereby reflect light emitted from said illumination source back through said light transmissive region adjacent to said first mirror plate.

19. The mirror of claim 18 wherein said light reflective member comprises a thin plate which has front and rear light reflective surfaces, said plate having a radially inwardly located peripheral edge spaced radially outwardly of said illumination source to thereby enable axial motion of said plate relative to said illumination source between said first and second positions.

20. The mirror of claim 19 wherein said reflective member has the shape of an annular ring.

21. The mirror of claim 20 wherein said reflective member includes at a first guide aperture through its thickness dimension which axially slidably contacts a first guide member.

22. The mirror of claim 21 wherein said reflective member includes a second guide aperture through its thickness dimension which axially slidably contacts a second guide member.

23. The mirror of claim 22 wherein said first and second guide apertures include first and second circumferentially spaced apart slots which extend radially into said annular ring from a first peripheral edge wall thereof.

24. The mirror claim 23 wherein said slots are diametrically opposed.

25. The mirror of claim 24 wherein said first and second guide members include first and second diametrically opposed sections which are disposed axially between inner facing surfaces of said first and second mirror plates.

26. The mirror of claim 25 wherein each of said first and second guide members are electrically conductively coupled to said illumination source to thereby conduct electrical power to said illumination source.

27. The mirror of claim 23 wherein said slots penetrate a second peripheral edge wall of said annular ring to thus sever said ring into first and second semi-annular rings.

28. A mirror comprising;

a. a mirror assembly including a mirror frame holding therein at least a first reflective mirror plate, said first reflective mirror plate having a central axially outwardly facing imaging light reflective surface, said mirror assembly including a light transmissive region adjacent to said imaging reflective surface, b. an electrically energizable illumination source located within said frame axially inwardly of said light transmissive region of said first reflective mirror plate, said illumination source including an elongated, thin, narrow strip made of a flexible material bent into an arcuately curved beam having a plurality of longitudinally spaced apart light sources protruding from a curved surface of said beam, c. a first light reflective member located axially inwardly of said light sources, said first light reflective member having a light reflective surface facing said light transmissive region of said first reflective mirror plate, d. a second reflective mirror plate having a central axially outwardly facing imaging light reflective surface and a light transmissive region adjacent to said imaging light reflective surface, said second mirror plate being located on a side of said illumination source axially opposed to that of said first reflective mirror plate, and e. wherein at least one of said light transmissive regions is part of one of said first and second mirror plates.

29. The mirror of claim 28 further including at least a first light reflective member located axially inwardly of said illumination source, said first light reflective member having a light reflective surface facing said light transmissive region of said first reflective mirror plate.

30. The mirror of claim 29 wherein said first light reflective member is located on a reverse, axially inwardly located surface of said second reflective mirror plate.

31. The mirror of claim 29 further including a second light reflective member located axially inwardly of said illumination source, said second light reflective member having a light reflective surface facing said light transmissive region of said second reflective mirror plate.

32. The mirror of claim 31 wherein said second light reflective member is located on a reverse, axially inwardly located surface of said first reflective mirror plate.

33. The mirror of claim 28 further including a light reflective member axially movable within said mirror frame between a first position located between said illumination source and said first reflective mirror plate to thereby reflect light emitted from said illumination source back through said light transmissive region adjacent to said second mirror plate, and a second position located between said illumination source and said second mirror plate to thereby reflect light emitted from said illumination source back through said light transmissive region adjacent to said first mirror plate.

34. The mirror of claim 33 wherein said light reflective member comprises a thin plate which has front and rear light reflective surfaces, said plate having a radially inwardly located peripheral edge spaced radially outwardly of said illumination source to thereby enable axial motion of said plate relative to said illumination source between said first and second positions.

35. The mirror of claim 34 wherein said reflective member has the shape of an annular ring.

36. The mirror of claim 35 wherein said reflective member includes at a first guide aperture through its thickness dimension which axially slidably contacts a first guide member.

37. The mirror of claim 36 wherein said reflective member includes a second guide aperture through its thickness dimension which axially slidably contacts a second guide member.

38. The mirror of claim 37 wherein said first and second guide apertures include first and second circumferentially spaced apart slots which extend radially into said annular ring from a first peripheral edge wall thereof.

39. The mirror claim 38 wherein said slots are diametrically opposed.

40. The mirror of claim 39 wherein said first and second guide members include first and second diametrically opposed sections which are disposed axially between inner facing surfaces of said first and second mirror plates.

41. The mirror of claim 40 wherein each of said first and second guide members are electrically conductively coupled to said illumination source to thereby conduct electrical power to said illumination source.

42. The mirror of claim 39 wherein said slots penetrate a second peripheral edge wall of said annular ring to thus sever said ring into first and second semi-annular rings.

* * * * *